US010612741B2

(12) United States Patent
Moser et al.

(10) Patent No.: US 10,612,741 B2
(45) Date of Patent: Apr. 7, 2020

(54) MICRO-PROJECTION LIGHT MODULE FOR A MOTOR VEHICLE HEADLIGHT, FOR ACHIEVING APLANATIC LIGHT DISTRIBUTION

(71) Applicant: ZKW Group GmbH, Wieselburg (AT)

(72) Inventors: Andreas Moser, Perg (AT); Bernhard Mandl, Ober-Grafendorf (AT); Christian Jackl, Wieselburg (AT)

(73) Assignee: ZKW Group GmbH, Wieselburg (AT)

( * ) Notice: Subject to any disclaimer, the term of this patent is extended or adjusted under 35 U.S.C. 154(b) by 0 days.

(21) Appl. No.: 15/767,161

(22) PCT Filed: Oct. 24, 2016

(86) PCT No.: PCT/AT2016/060088
§ 371 (c)(1),
(2) Date: Apr. 10, 2018

(87) PCT Pub. No.: WO2017/066818
PCT Pub. Date: Apr. 27, 2017

(65) Prior Publication Data

US 2019/0072252 A1 Mar. 7, 2019

(30) Foreign Application Priority Data

Oct. 23, 2015 (AT) ..... A 50905/2015

(51) Int. Cl.
*F21S 8/00* (2006.01)
*F21S 41/275* (2018.01)
(Continued)

(52) U.S. Cl.
CPC ..... *F21S 41/275* (2018.01); *F21S 41/143* (2018.01); *F21S 41/20* (2018.01); *F21S 41/265* (2018.01);
(Continued)

(58) Field of Classification Search
CPC ..... F21S 41/275; F21S 41/143; F21S 41/68; F21S 41/255
See application file for complete search history.

(56) References Cited

U.S. PATENT DOCUMENTS 6,769,777 B1 8/2004 Dubin et al.
9,951,919 B2 * 4/2018 Bauer ..... G02B 3/0006

FOREIGN PATENT DOCUMENTS

DE 3241713 A1 5/1984
EP 3404343 A1 * 11/2018 ..... F25B 13/00
(Continued)

OTHER PUBLICATIONS

Search Report issued in Austrian Application No. A 50905/2015, completed Aug. 29, 2016 (1 page).
(Continued)

*Primary Examiner* — Karabi Guharay
(74) *Attorney, Agent, or Firm* — Eversheds Sutherland (US) LLP

(57) ABSTRACT

The invention relates to a microprojection light module (1) for a motor vehicle headlight, comprising at least one light source (2) and at least one projection device (3), which images the light exiting the at least one light source (2) into a region in front of the motor vehicle in the form of at least one light distribution, wherein the projection device (3) comprises an entrance lens system (30) including one, two or more micro entrance lenses (31), which are preferably arranged in an array, and an exit lens system (40) including one, two or more micro exit lenses (41), which are preferably arranged in an array, wherein each micro entrance lens (31) is associated with exactly one micro exit lens (41), wherein the micro entrance lenses (31) are designed in such a way and/or the micro entrance lenses (31) and the micro exit lenses (41) are arranged with respect to one another in such a way that substantially all the light exiting the micro
(Continued)

Figure 1:
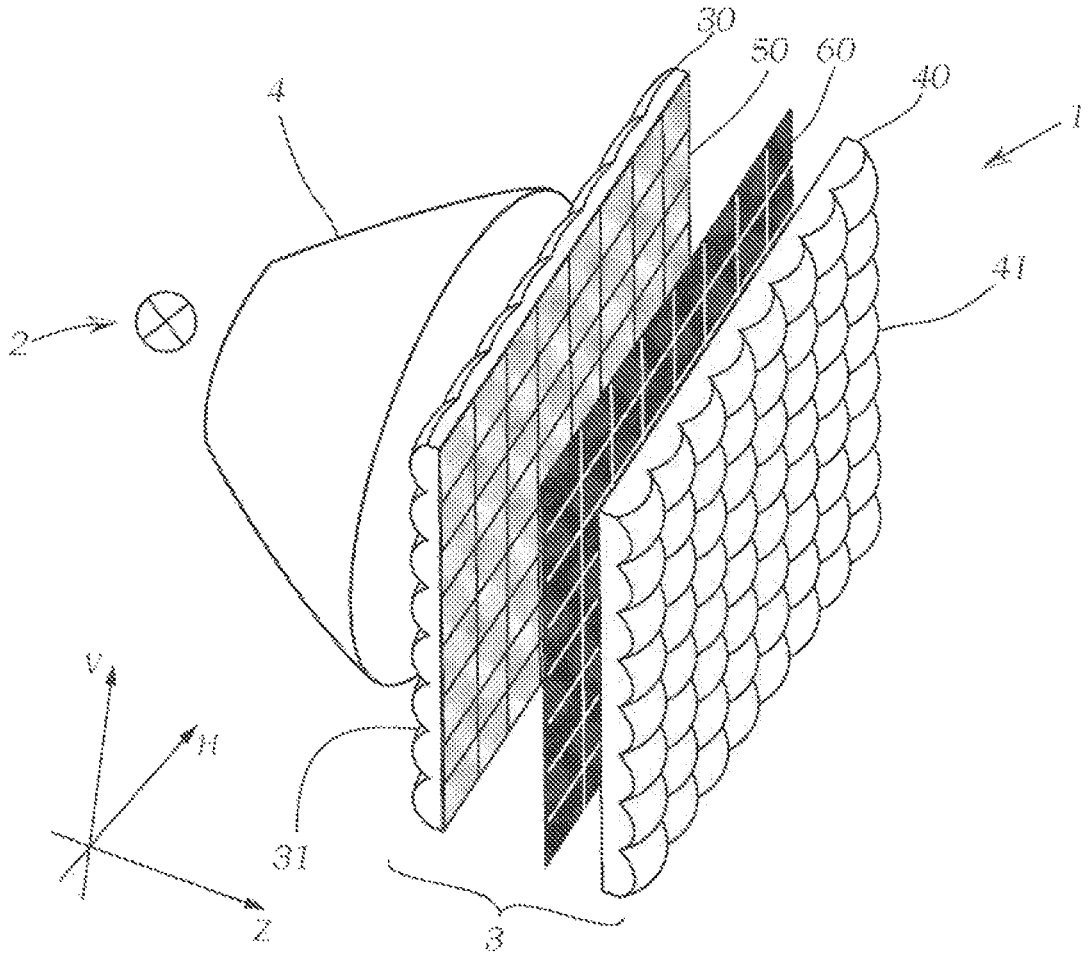

entrance lens (31) enters exactly only the associated micro exit lens (41), and wherein the light preshaped by the micro entrance lenses (31) is imaged by the micro exit lenses (41) into a region in front of the motor vehicle as at least one light distribution (LV1 to LV5; GLV), wherein a first diaphragm device (50) is arranged between the entrance lens system (30) and the exit lens system (40), wherein at least one second diaphragm device (60, 70) is arranged between the entrance lens system (30) and the exit lens system (40).

32 Claims, 12 Drawing Sheets

(51) Int. Cl.

| | |
|---|---|
| ***F21S 41/63*** | (2018.01) |
| ***F21S 41/683*** | (2018.01) |
| ***F21S 41/68*** | (2018.01) |
| ***F21S 41/43*** | (2018.01) |
| ***F21S 41/143*** | (2018.01) |
| ***F21S 41/686*** | (2018.01) |
| ***F21S 41/265*** | (2018.01) |
| ***F21S 43/14*** | (2018.01) |
| ***F21S 41/20*** | (2018.01) |
| ***F21V 11/18*** | (2006.01) |

(52) U.S. Cl.

CPC ..... *F21S 41/285* (2018.01); *F21S 41/43* (2018.01); *F21S 41/635* (2018.01); *F21S 41/68* (2018.01); *F21S 41/683* (2018.01); *F21S 41/686* (2018.01); *F21S 43/14* (2018.01); *F21V 11/186* (2013.01)

(56) References Cited

FOREIGN PATENT DOCUMENTS

| | | | |
|---|---|---|---|
| JP | H02-103801 | A | 4/1990 |
| WO | 2011/132108 | A1 | 10/2011 |
| WO | 2014/164792 | A1 | 10/2014 |

OTHER PUBLICATIONS

International Search Report for PCT/AT2016/060088, dated Feb. 28, 2017 (2 pages).

* cited by examiner 31
41

31
41

31
41
50
60,70,80

MICRO-PROJECTION LIGHT MODULE FOR A MOTOR VEHICLE HEADLIGHT, FOR ACHIEVING APLANATIC LIGHT DISTRIBUTION

The invention relates to a microprojection light module for a motor vehicle headlight, comprising at least one light source and at least one projection device, which images the light exiting the at least one light source into a region in front of the motor vehicle in the form of at least one light distribution, wherein the projection device comprises an entrance lens system including one, two or more micro entrance lenses, which are preferably arranged in an array, and an exit lens system including one, two or more micro exit lenses, which are preferably arranged in an array, wherein each micro entrance lens is associated with exactly one micro exit lens, wherein the micro entrance lenses are designed in such a way and/or the micro entrance lenses and the micro exit lenses are arranged with respect to one another in such a way that substantially all the light exiting the micro entrance lens enters exactly only the associated micro exit lens, and wherein the light preshaped by the micro entrance lenses is imaged by the micro exit lenses into a region in front of the motor vehicle as at least one light distribution, wherein a first diaphragm device is arranged between the entrance lens system and the exit lens system.

The invention furthermore relates to an illumination device comprising at least one such microprojection light module.

Moreover, the invention relates to a vehicle headlight comprising at least one such illumination device.

Microprojection light modules of the above-described type are known from the prior art. In AT 514967 B1 by the applicant, a microprojection light module for a vehicle headlight comprising a diaphragm device for generating a light distribution of a predefined type is disclosed. In the process, "crosstalk" (see FIG. 2*b* of the present application) occurs in the projection system, as do aberrations (for example, due to non-paraxial rays, or chromatic aberration (longitudinal and/or lateral chromatic aberrations)) due to the projection system. Due to these two sources of defects, the resultant light distribution, which is projected as a light pattern in front of the microprojection light module, is not free from aberrations, wherein an "aberration-free light distribution" in the context of the present invention shall be understood to mean a light distribution without aberrations of the type described in the present application and without scattered light due to crosstalk.

It is thus an object of the invention to further develop a microprojection light module mentioned at the outset for a motor vehicle headlight to the effect that aberration-free light distributions of a certain type, for example having a light-dark boundary, can be generated.

For this purpose, "a certain type" of light distribution shall be understood to mean a light distribution generated in accordance with relevant standards, for example a light distribution according to the standards of the UN/ECE Regulations in the member nations of the European union, in particular Regulations 123 and 48, or relevant standards in other regions of the world.

This object is achieved by a microprojection light module mentioned at the outset in that at least one second diaphragm device is arranged between the entrance lens system and the exit lens system.

It may be provided that the second diaphragm device is arranged between the first diaphragm device and the exit lens system.

In particular, it may be advantageous when a micro entrance lens and a micro exit lens associated with the micro entrance lens form a micro lens system, the micro lens system having at least one micro lens focal point.

It may be provided that each micro entrance lens focuses the light passing through it into the at least one micro lens focal point.

Moreover, it may be advantageous when a micro lens focal point of each micro entrance lens is located in front of the associated micro exit lens, in the light exit direction.

Furthermore, it may be provided that the micro entrance lenses focus the light passing through them in the vertical direction onto the respective micro lens focal point located in front of the micro exit lens.

In a preferred embodiment, it may be provided that the micro exit lenses have a focal point that coincides with the respective micro lens focal point of the associated micro entrance lens.

Light is thus focused into the focal point of the micro lens system and subsequently, after passing through the micro exit lens, is accordingly in the vertical direction and projected into a region in front of the vehicle.

Moreover, it may advantageously be provided that each micro lens system widens the light passing through it in the horizontal direction.

Each micro lens system focuses the light passing through in the vertical direction onto a micro lens focal point, which is preferably located behind the micro entrance lens and in front of the micro exit lens. This light furthermore passes through the micro exit lens and is then focused in the horizontal direction into a focal point, which is preferably located behind the micro exit lens.

The terms "in front of" and "behind" refer to the main propagation direction of the light emitted by the microprojection light module.

It may be advantageous when the micro entrance lenses are designed as converging lenses.

Furthermore, it may be provided that the micro entrance lenses are designed as free-form lenses.

It is expedient when the micro exit lenses are designed as projection lenses.

Moreover, it may be provided that the micro exit lenses are designed as spherical or aspherical lenses.

It may additionally be advantageous when the micro exit lenses are designed as free-form lenses.

In a specific, particularly preferred embodiment of the invention, it is provided that the mutually facing interfaces of mutually associated micro entrance lenses and micro exit lenses are designed so as to be congruent, and preferably are also arranged congruently with respect to one another.

"Designed so as to be congruent" shall be understood to mean nothing other than that the interfaces of mutually associated micro lenses have the same shape in terms of the base area, having essentially any arbitrary spatial arrangement. Arranged "congruently" shall mean that these base areas additionally are also arranged in such a way that these would transition into one another in a coinciding manner when superimposed if displaced normally to one of the base areas.

It is particularly advantageous if the optical axes of mutually associated micro entrance lenses and micro exit lenses extend parallel to each other, and preferably coincide. In this way, the light pattern of each individual micro lens system is imaged particularly exactly with respect to the position thereof, so that, when the individual light patterns are superimposed so as to form a desired overall light distribution, such as a low beams light distribution, this can be optimally generated from an optical point of view.

The base areas of the lens systems can be hexagonal, rectangular or preferably square, for example.

With respect to the quality of the light pattern, it may be advantageous when the first diaphragm device is located in a plane spanned by the micro lens focal points.

It may be provided that the first diaphragm device comprises a diaphragm having at least one respective, for example exactly one, optically effective diaphragm edge for at least one pair of mutually associated micro entrance lenses and micro exit lenses, preferably for multiple pairs, and in particular for all pairs.

With respect to the production complexity, it may be advantageous when all diaphragms of the first diaphragm device have identical diaphragm edges.

With respect to the light pattern design, it may be provided that at least two diaphragms of the first diaphragm device have differently configured diaphragm edges.

So as to deliberately correct the aberrations, it may be advantageous when the second diaphragm device comprises a diaphragm having at least one respective, for example exactly one, optically effective diaphragm edge for at least one pair of mutually associated micro entrance lenses and micro exit lenses, preferably for multiple pairs, and in particular for all pairs.

In a specific embodiment, it may be provided that all diaphragms of the second diaphragm device have identical diaphragm edges.

Moreover, it is particularly advantageous when at least two diaphragms of the second diaphragm device have differently configured diaphragm edges.

With respect to the aberrations, which are caused by the field of curvature and distortion of the projection device, it may be advantageous when at least one, and preferably two, of the optically effective diaphragm edges has or have a gable-like progression.

It may be advantageous that the gable-like progression of the at least one optically effective diaphragm edge is outwardly directed with respect to the diaphragm stop. If the gable edges have a rectilinear progression, the diaphragm stop, from a mathematical perspective, is designed as a two-dimensional substantially convex set. The gable-like progression can have the shape of a triangle or a curved gable, for example, or can be rounded or trapezoidal.

Moreover, it may be advantageous when, with respect to the vertical direction, a lower optically effective diaphragm edge and/or an upper optically effective diaphragm edge of the diaphragm comprise two or more curved and/or rectilinear segments, and in particular have a triangular or trapezoidal or curved or circular design.

It shall be noted at this point that it can be within the meaning of the invention when the lower and/or upper optically effective diaphragm edges have a gable-like design from the optical axis outwardly toward the diaphragm. This may be a steep or flat or normal shape of the gable.

With respect to the reduction of crosstalk and aberrations, it may be advantageous when the second diaphragm device is arranged in relation to the first diaphragm device in such a way that the diaphragms of the second diaphragm device are offset vertically, which is to say parallel to a vertical axis, with respect to the diaphragms of the first diaphragm device.

With respect to the adaptation of the aperture of micro lens systems, it is advantageous when the first diaphragm device and the second diaphragm device are spaced apart from one another. The second diaphragm device has the function of an aperture stop, which can be used to correct the aberrations.

In principle, a projection device, as described above, comprises a plurality of micro lens systems, which is to say pairs that each comprise a micro entrance lens and a micro exit lens. In the simplest embodiment without diaphragm devices, all micro lens systems generate the same light distribution, the (partial) light distributions in sum forming a high-beam light distribution, for example. For the sake of simplicity, it shall be assumed here that a complete light distribution is generated by exactly one light module. In practice, however, it may also be provided that two or more light modules according to the invention are used to generate the overall light distribution. This may be useful, for example, when the components have to be divided among different positions in the headlight, for example due to space constraints.

So as to generate a dimmed light distribution, such as a low-beam light distribution, which, as is known, has a light-dark boundary, it may then be provided that substantially identical diaphragms are associated with each micro lens system in the beam path, so that all micro lens systems generate a light distribution having a light-dark boundary. The superimposition of all light distributions then yields the dimmed light distribution, serving as the overall light distribution.

In this case, as well as in all other instances, the diaphragms can be designed as individual diaphragms (for example, in the form of an opaque layer, such as a vapor-deposited layer, and the like), which "form" the first diaphragm device; however, this may also be a diaphragm device component, such as a flat foil and the like, this diaphragm device component being provided with appropriate openings for light to pass through. This results in the above-mentioned aberrations, which will be described in more detail hereafter, which can then be eliminated by inserting the second diaphragm device.

Moreover, it may also be provided that different diaphragms are provided, which is to say that a first diaphragm of the first diaphragm device and a second diaphragm of the second diaphragm device are associated with one or more micro lens systems, at least one respective other diaphragm, which is identical to the first diaphragm or different from the first diaphragm, of the first diaphragm device (or no diaphragm) and one other diaphragm, which is identical to the second diaphragm or different from the second diaphragm, of the second diaphragm device (or no diaphragm), are associated with one or more other micro lens systems, and so forth, so that different micro lens systems form different aberration-free light distributions. By selectively activating individual micro lens systems, for which purpose, however, it is necessary that dedicated light sources, which can be separately actuated at least in groups, are associated therewith, it is possible to generate individual, different light distributions, which can also be operated in superimposition with one another.

Furthermore, it may be provided that the first diaphragm device and the second diaphragm device have an identical design.

It may be advantageous when the second diaphragm device is arranged in a mirrored fashion in relation to the first diaphragm device with respect to a horizontal plane.

However, it may also be provided that the first diaphragm device is designed in one piece with the second diaphragm device.

It may be advantageous when the projection device, comprising the entrance lens system and the exit lens system, and the first diaphragm device and the second diaphragm device, is designed in one piece.

Moreover, it may be provided that the projection device comprising the entrance lens system and the exit lens system is formed of two separate components.

Furthermore, it may be provided that the first diaphragm device is arranged on the interface of the entrance lens system which faces the exit lens system.

It is also advantageous when the first diaphragm device is designed as a component that is separate from the entrance lens system, the exit lens system and the second diaphragm device.

In an advantageous embodiment, it is provided that the second diaphragm device is arranged on the interface of the exit lens system which faces the entrance lens system.

It may be provided that the second diaphragm device is formed as a component that is separate from the entrance lens system, the exit lens system and the first diaphragm device.

Furthermore, it may be provided that the at least one light source comprises at least one semiconductor light source, such as at least one light-emitting diode and/or at least one laser diode.

It is advantageous when at least one supplementary lens unit is arranged between the at least one light source and the at least one projection device, the at least one light source radiating the light emitted by it into this at least one supplementary lens unit, and the supplementary lens unit being designed in such a way that the light exiting therefrom is directed substantially parallel.

It may be advantageous when the supplementary lens unit is designed as a collimator.

It is particularly advantageous when the light source comprises at least one semiconductor-based light source, the at least one semiconductor-based light source comprising one, two or more LEDs and/or laser diodes, wherein the one, two or more LEDs and/or laser diodes of the at least one semiconductor-based light source are actuatable independently of one another.

Here, "actuatable" shall primarily be understood to mean switching on and off. Additionally, this may also be understood to mean dimming the one, two or more LEDs and/or laser diodes of the at least one semiconductor-based light source.

It may be advantageous when the light source are actuatable independently of one another, if two or more light sources are present.

"Independently of one another" shall be understood to mean that effectively all light sources can be actuated independently of one another, or that the light sources can be actuated independently of one another in groups.

In one embodiment of the invention, it is provided that exactly one light source, which preferably comprises exactly one light-emitting diode or exactly one laser diode, is associated with each micro lens system comprising a micro entrance lens and a micro exit lens.

Moreover, it may be provided that two or more light source groups are provided, wherein each light source group comprises at least one light source, and wherein the light sources of a light source group emit light of the same color, and wherein the light sources of different light source groups emit different colors, and wherein each light source group illuminates a region of the at least one projection device which is associated specifically with this light source group, and wherein the different regions have identical designs or are designed to generate identical light distributions.

It should be noted that the position of the first diaphragm device and/or of the second diaphragm device and/or the shape of the entrance lens systems (for example, the thickness of the respective entrance lens system and/or the curvatures of the micro entrance lenses forming the entrance lens systems) should be adapted to the particular light source group. As mentioned above, the first diaphragm device is preferably arranged in the focal surface of the projection device. As a result of the dispersion (dependence of the refractive index on the wavelength of the light) of the material of which the entrance and exit lens systems are made, the positions of the focal points of the micro lens systems are different for each color (green, red or blue). The focal surfaces of the portions of one and the same projection device which are irradiated with red, green or blue light, for example, or of the irradiated projection devices consequently do not necessarily coincide. This, in turn, may result in chromatic aberrations (longitudinal and/or lateral chromatic aberrations) in the light pattern (in the radiated light distribution) when the position of the first diaphragm device, and possibly also that of the second diaphragm device, is adapted to the color of the light emitted by the light sources.

It is advantageous when three light source groups are provided, wherein preferably one light source group emits red light, one light source group emits green light, and one light source group emits blue light.

The objects described at the outset are furthermore achieved by an illumination device for a vehicle headlight which comprises at least one, and preferably two or more, microprojection light modules as described above.

It may be advantageous when two or more groups of microprojection light modules are provided, wherein each group comprises one, two or more microprojection light modules, wherein microprojection light modules of one group generate the same light distribution, and wherein microprojection light modules from different groups generate different light distributions.

A further advantage arises when the light sources of each group of microprojection light modules can be actuated independently of the light sources of the other groups.

It may also be provided that the projection devices of microprojection light modules of one group form a joint component.

Furthermore, it may be provided that the projection devices of all microprojection light modules form a joint component.

With respect to production, it may be particularly favorable when the joint component is, or the joint components are, designed in the form of a foil.

It may be expedient when two or more groups for generating different light distributions are provided, wherein each group forms a different light distribution, which is selected from one of the following light distributions:

*) turning light light distribution;

*) city light light distribution;

*) rural road light light distribution;

*) highway light light distribution;

*) light distribution for auxiliary light for highway light;

*) cornering light light distribution;

*) low-beam light light distribution;

*) low-beam light apron light distribution;

*) light distribution for asymmetrical low-beam light in the far field;

*) light distribution for asymmetrical low-beam light in the far field in cornering light mode;

*) high-beam light light distribution;

*) no-dazzle high-beam light light distribution.

Not exclusively, but in particular when laser light sources are used, it was also found to be favorable when the illumination device comprises two or more light modules, wherein each light module comprises at least one light source group, wherein each light source group comprises at least one light source, and wherein light sources of one light source group emit light of the same color, and wherein at least two light source groups are provided, which emit light of different colors, and wherein each light source group illuminates a region of the at least one projection device of the light module thereof which is associated specifically with this light source group, and wherein the different regions have identical designs or are designed to generate identical light distributions.

A particularly advantageous embodiment is yielded when the illumination device comprises two or more microprojection light modules, wherein each microprojection light module comprises at least one light source group, wherein each light source group comprises at least one light source, and wherein light sources of one light source group emit light of the same color, and wherein at least two light source groups are provided, which emit light of different colors, and wherein each light source group illuminates a region of the at least one projection device of the microprojection light module thereof which is associated specifically with this light source group, and wherein the different regions have identical designs or are designed to generate identical light distributions.

With respect to the generation of white light, is particularly favorable when three groups of light source groups are provided, wherein preferably one group of light source groups emits red light, one group of light source groups emits green light, and one group of light source groups emits blue light, and wherein each group of light source groups comprises at least one light source group.

An illumination device according to the invention may be an integral part of a headlight, which is to say may be combined with one or more light modules of another design to form a headlight, or the vehicle headlight is formed by the illumination device.

Figure 2A:
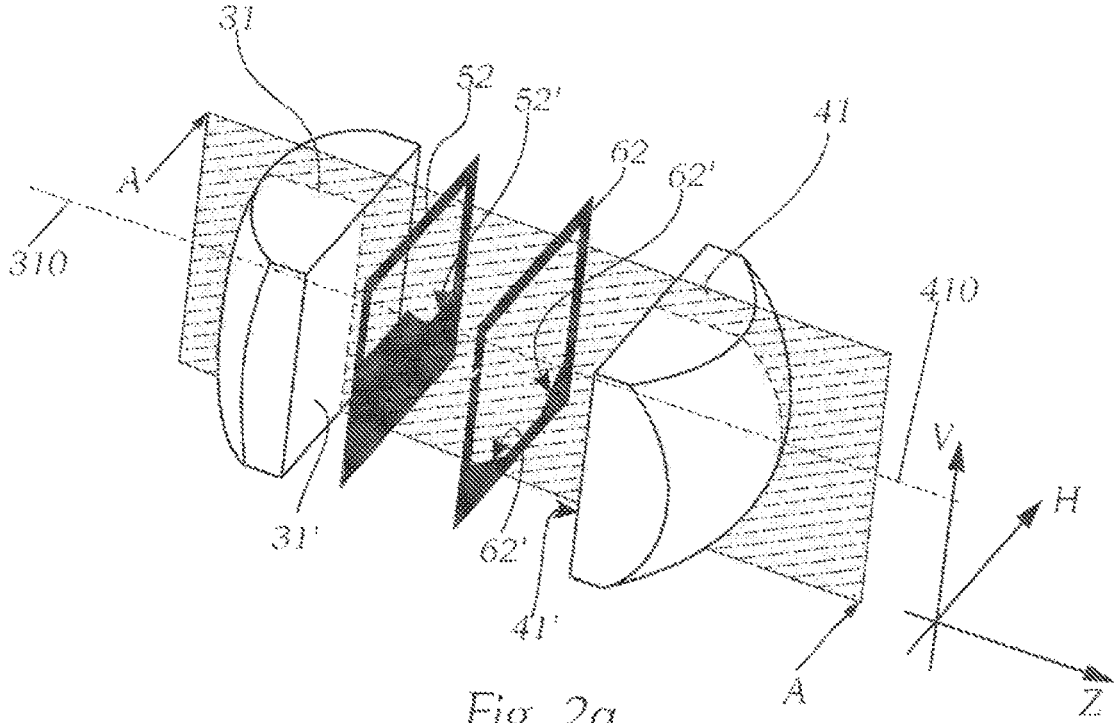
Figure 2B:
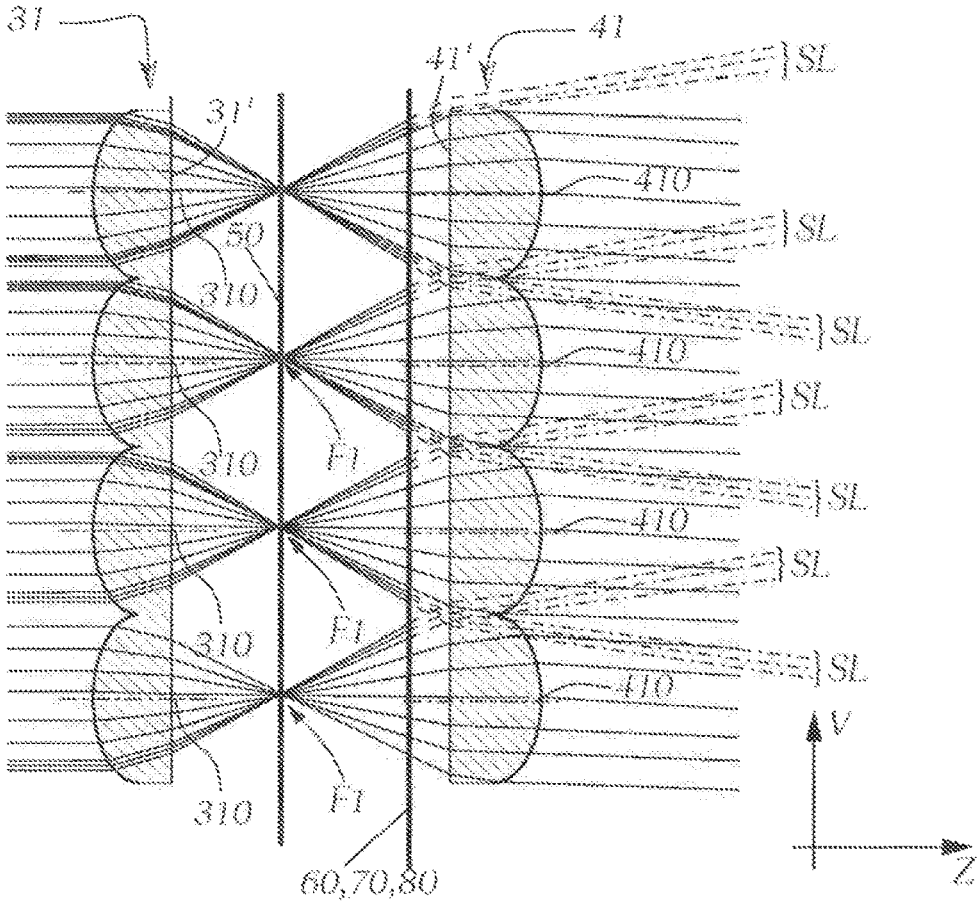
Figure 2C:
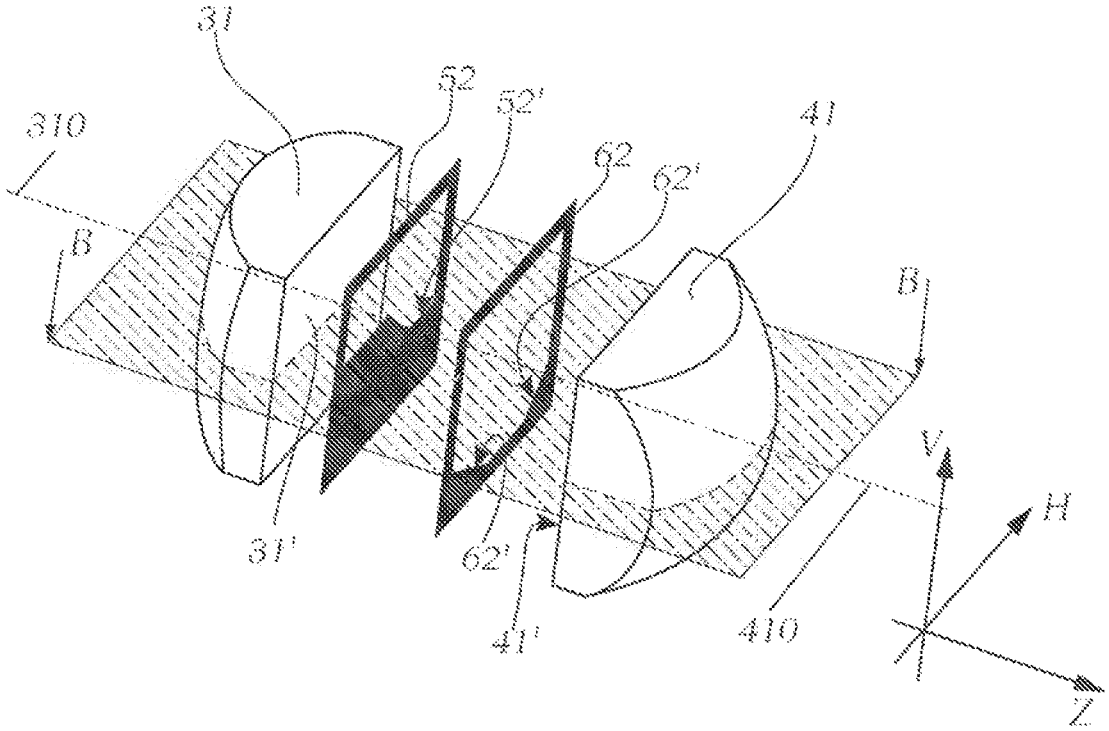
Figure 2D:
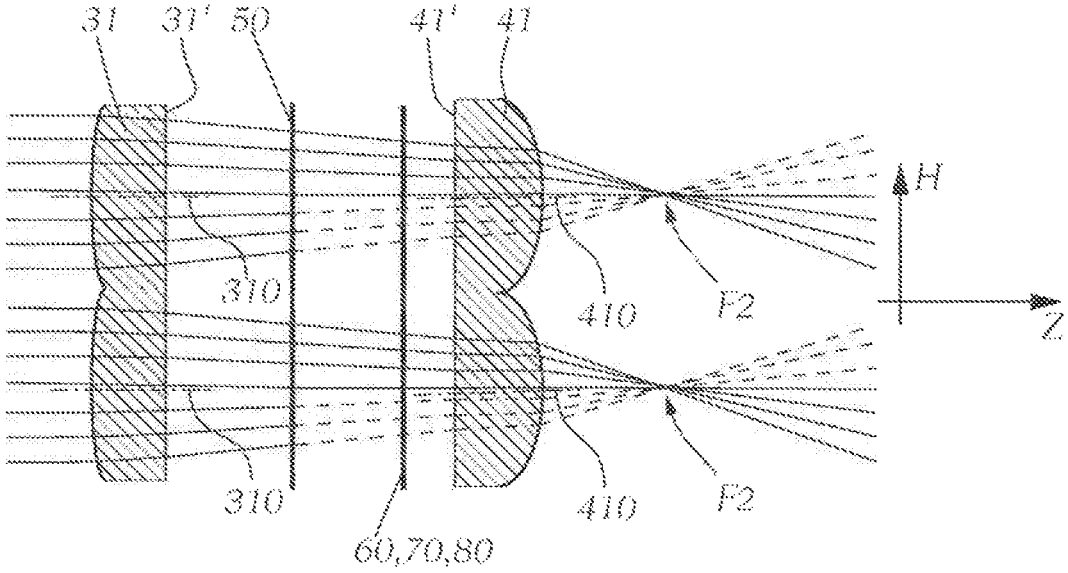
Figure 3B:
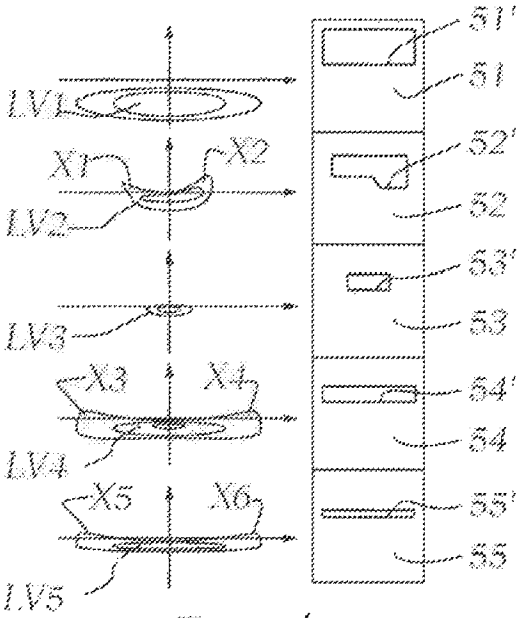
Figure 3A:
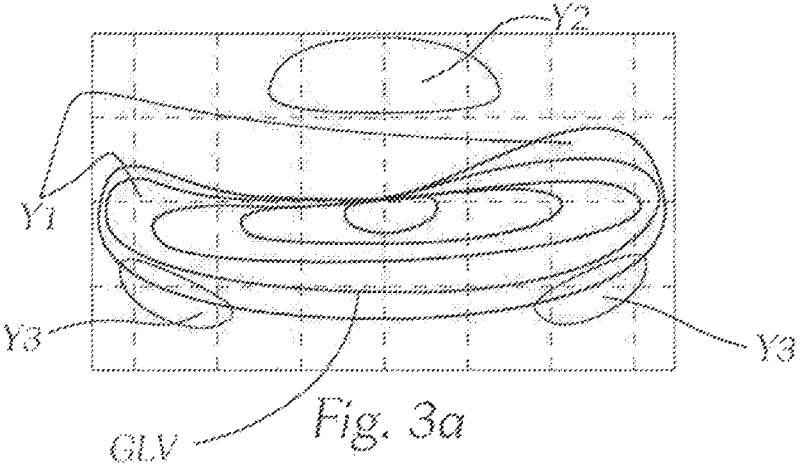
Figure 3:
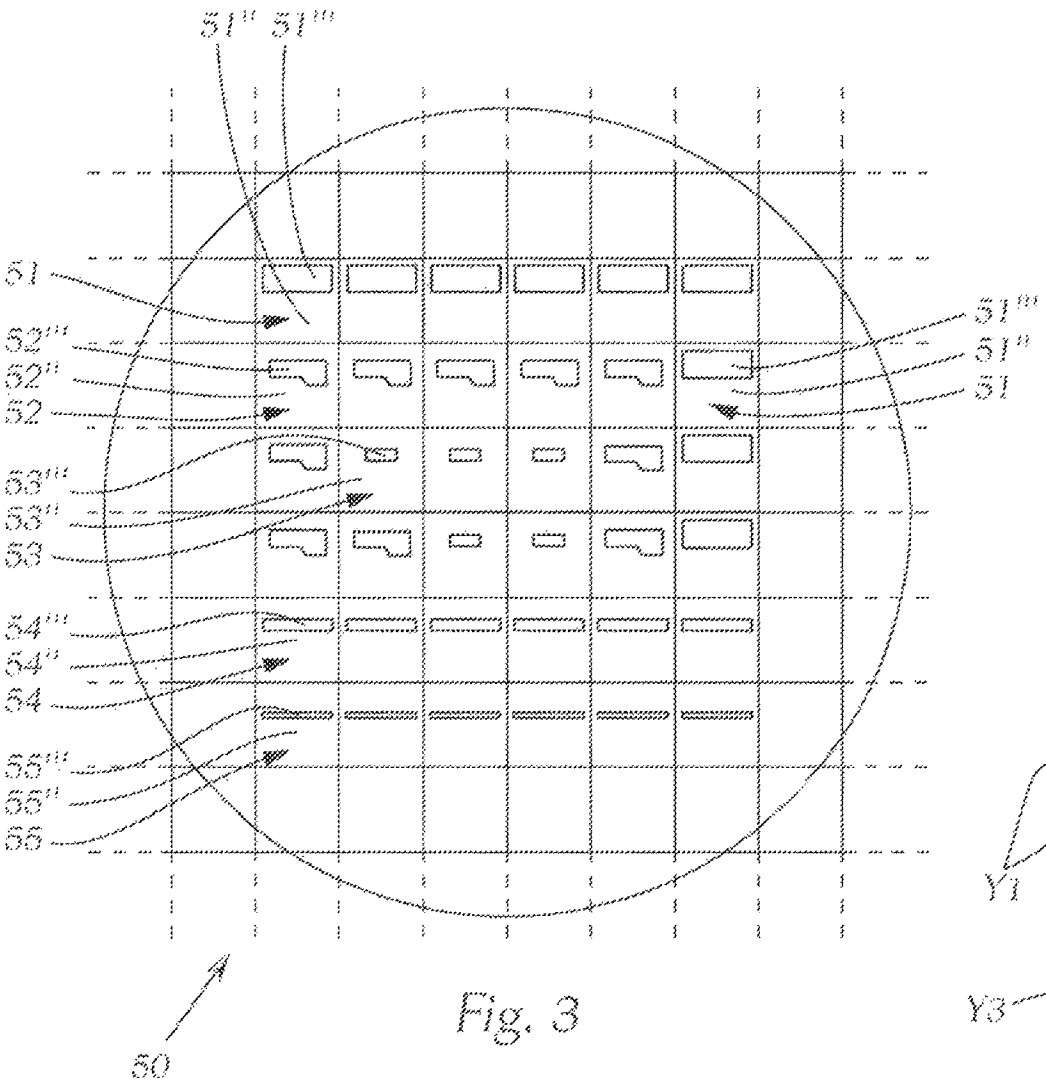

The invention will be described in more detail hereafter based on the drawings. In the drawings:

FIG. 1 shows a schematic representation of a microprojection light module according to the invention in an exploded view;

FIG. 2*a* shows a schematic representation of a micro lens system of a microprojection light module according to the invention in a perspective view and a vertical cutting plane;

FIG. 2*b* shows a sectional view through the micro lens system from FIG. 2*a* along plane A-A;

FIG. 2*c* shows a micro lens system from FIG. 2*a*, with a horizontal cutting plane;

FIG. 2*d* shows a sectional view through the micro lens system from FIG. 2*c* along plane B-B;

FIG. 3 shows a schematic representation of a first diaphragm device according to the prior art comprising one, two or more diaphragms;

FIG. 3*a* shows a schematic representation of an overall light distribution having aberrations, generated by way of a light module comprising the first diaphragm device according to the prior art from FIG. 3;

FIG. 3*b* shows the partial light distributions having aberrations, generated by way of the individual diaphragms of the first diaphragm device according to the prior art from FIG. 3, which together form the overall light distribution from FIG. 3*a;*

Figure 4:
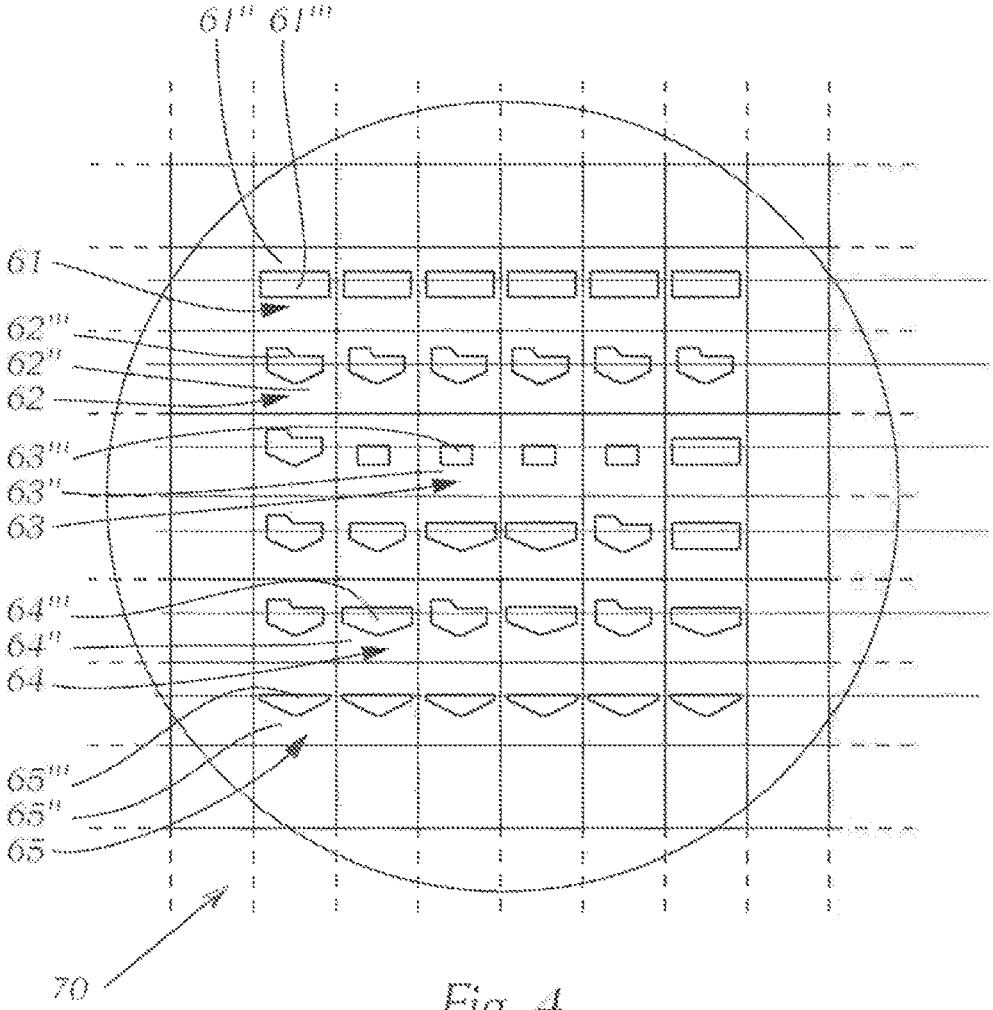
Figure 4A:
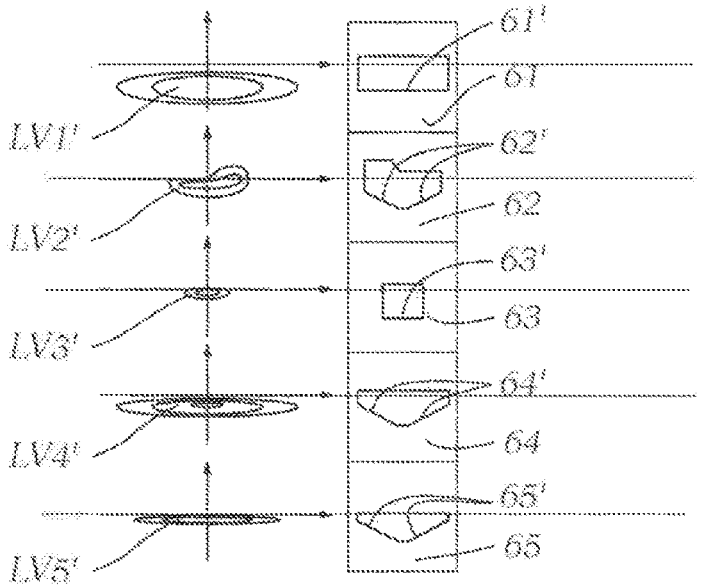
Figure 5:
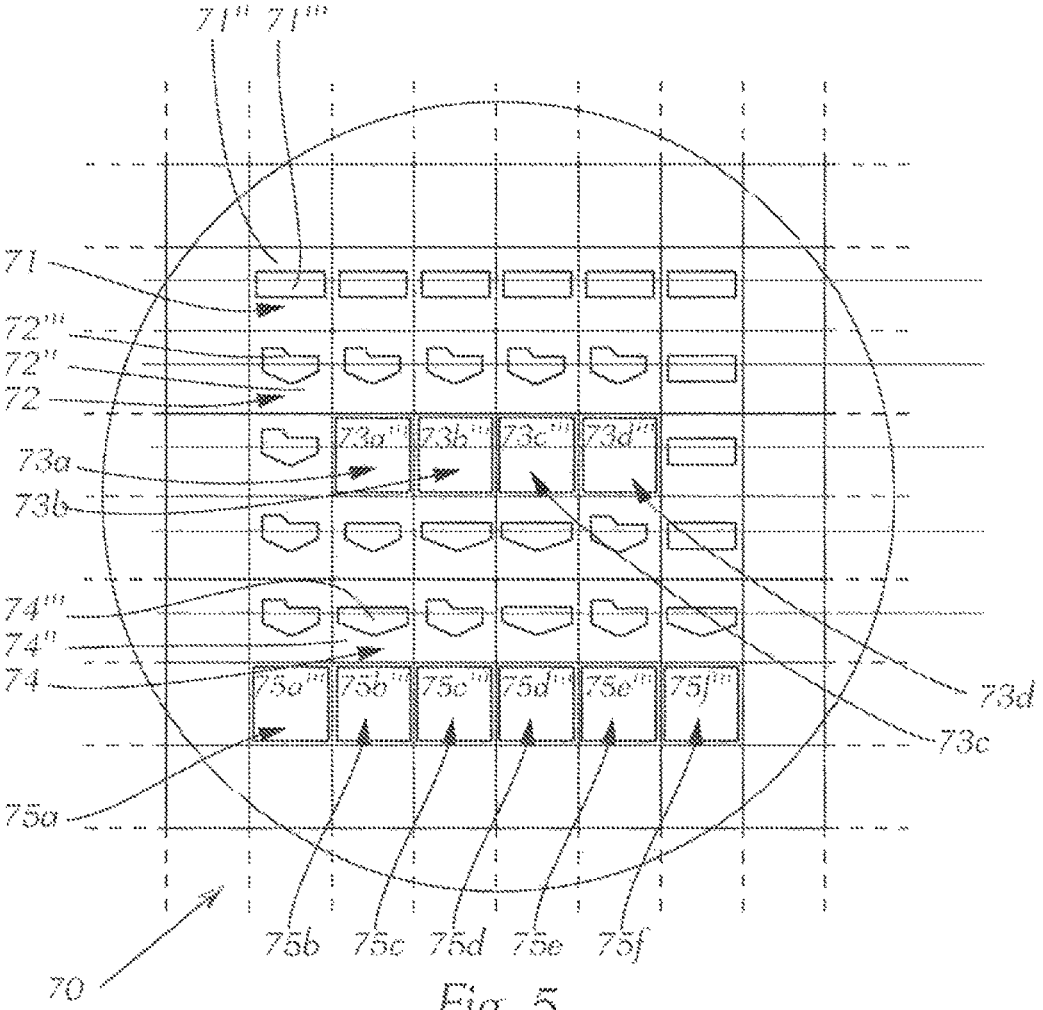
Figure 5A:
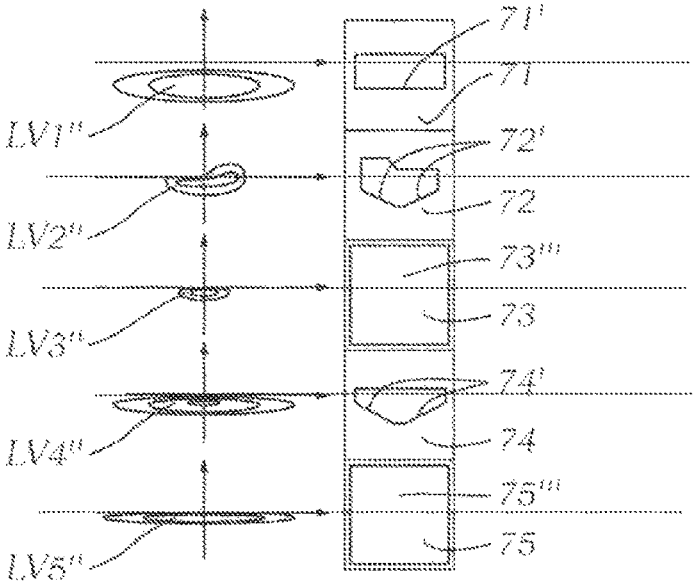
Figure 6A:
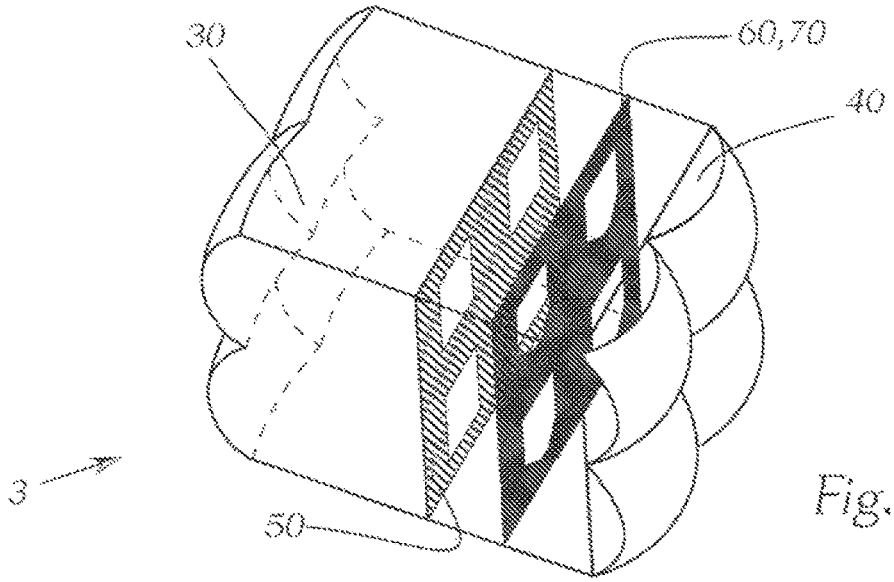
Figure 6B:
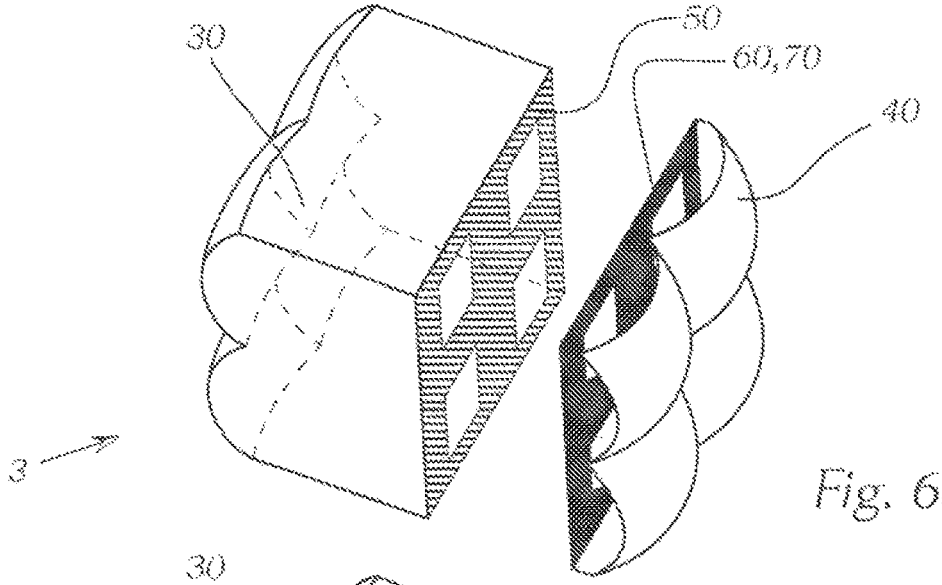
Figure 6C:
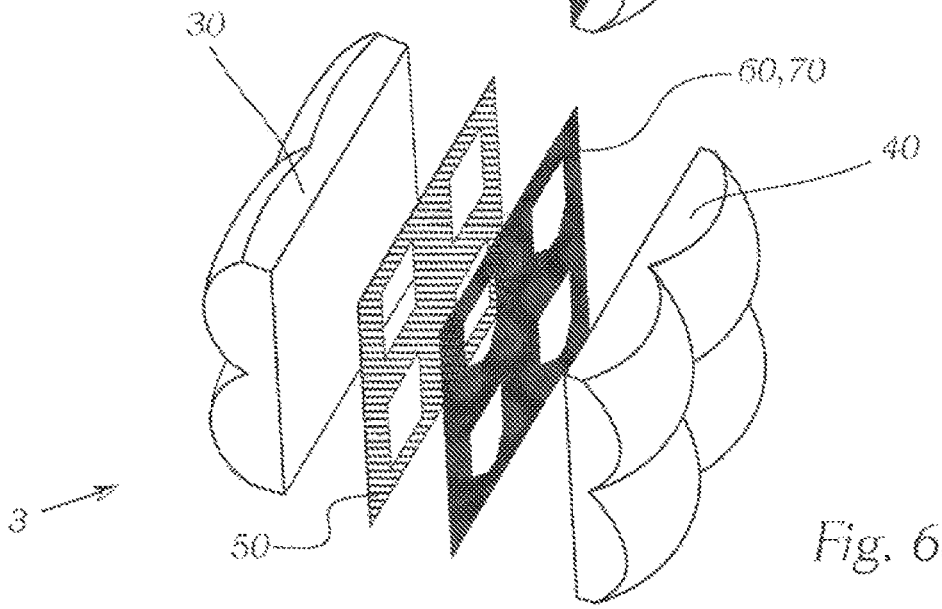
Figure 7:
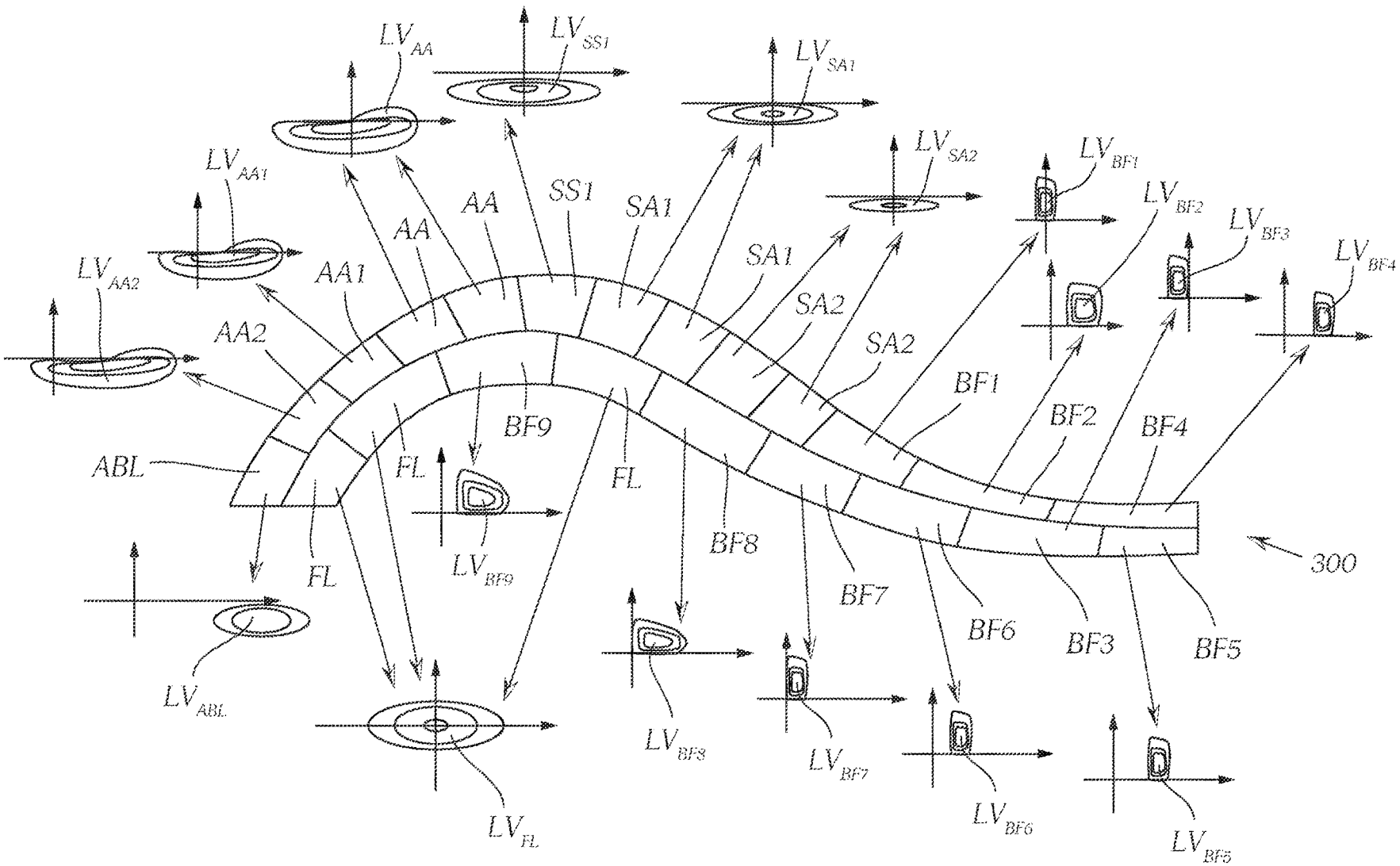
Figures 8A, 8B, 8C:
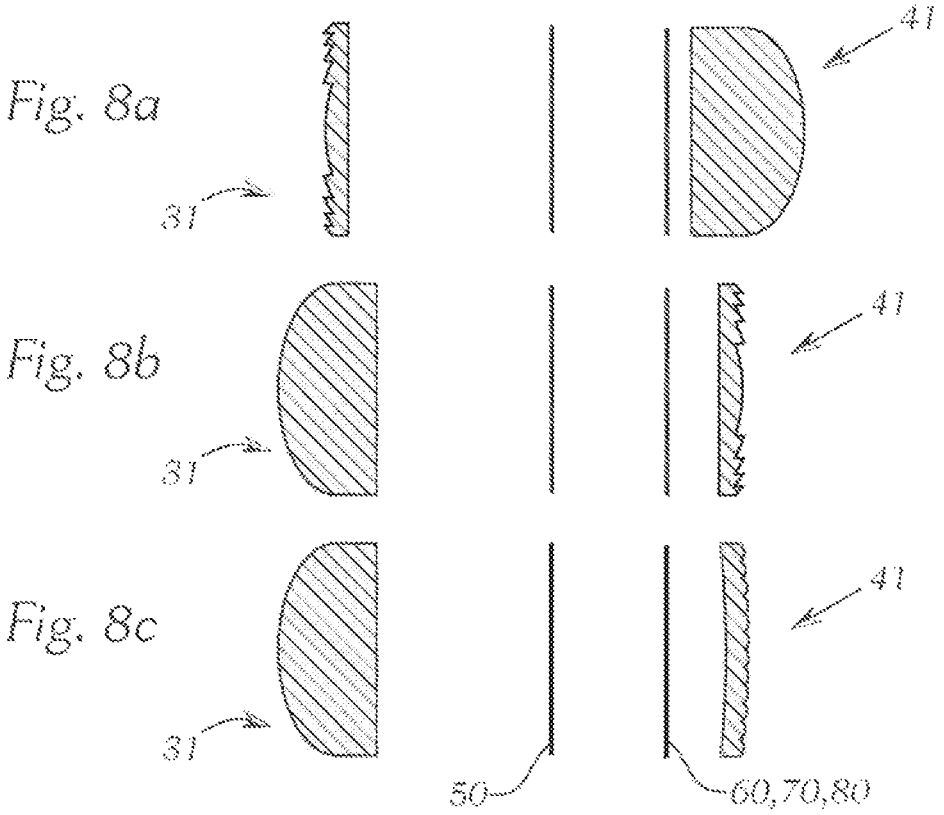
Figure 9A:
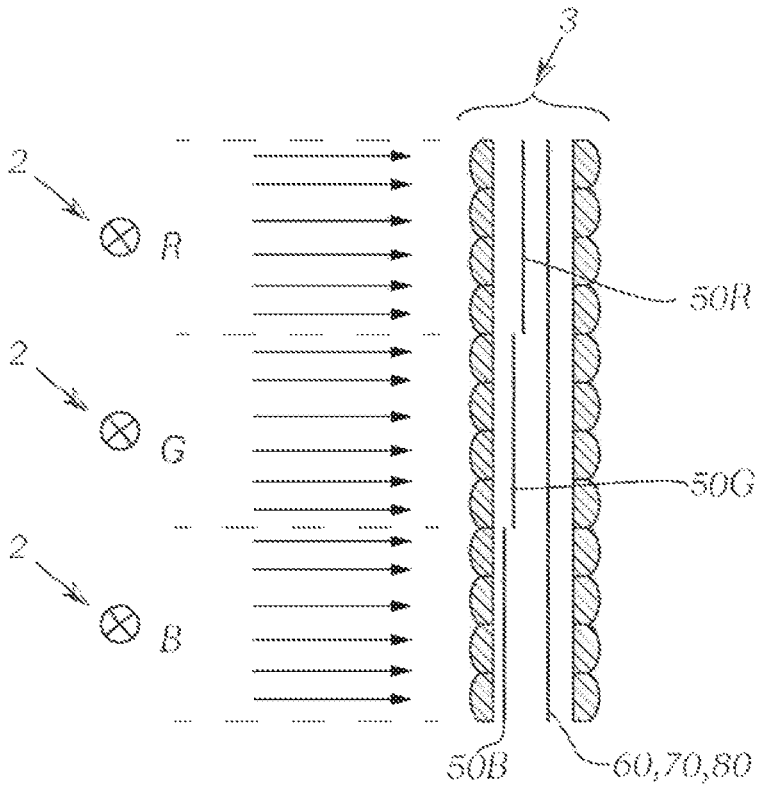
Figure 9B:
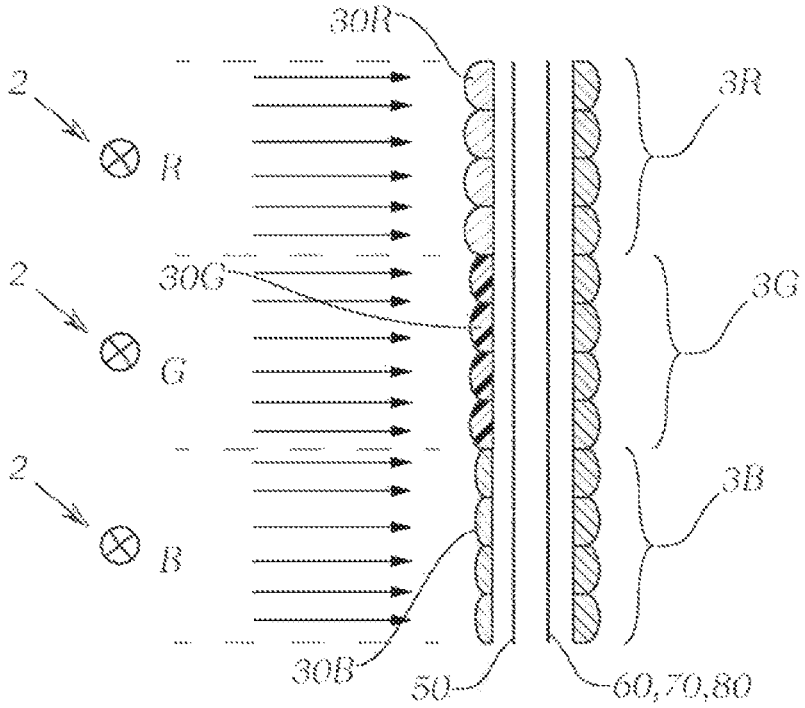

FIG. 4 shows a first variant of a second diaphragm device according to the invention;

FIG. 4*a* shows the partial light distributions having no aberrations, generated by way of the individual diaphragms of the second diaphragm device according to the invention from FIG. 4;

FIG. 5 shows a second variant of a second diaphragm device according to the invention;

FIG. 5*a* shows the partial light distributions having no aberrations, generated by way of the individual diaphragms of the second diaphragm device according to the invention from FIG. 5;

FIG. 6*a* shows a schematic detail of a projection device of a light module according to the invention in a single-piece design;

FIG. 6*b* shows a schematic detail of a projection device of a light module according to the invention in a two-piece design;

FIG. 6*c* shows a schematic detail of a projection device of a light module according to the invention in a four-piece design;

FIG. 7 shows a schematic representation of an illumination device, composed of a plurality of microprojection light modules according to the invention;

FIGS. 8*a* to 8*c* show different variants of micro lens systems;

FIG. 9*a* and FIG. 9*b* show a schematic arrangement for generating a white overall light distribution, using light sources of different colors; and FIG. 10 to FIG. 15 shows different embodiments of the diaphragms of the second diaphragm device.

FIG. 1 schematically shows a microprojection light module 1 according to the invention for a motor vehicle headlight. The microprojection light module 1 comprises a light source 2 and a projection device 3, which images the light exiting the light source 2 into a region in front of the motor vehicle in the form of at least one light distribution. The shown coordinates denote the light exit direction Z and the horizontal direction H, which is normal to Z and normal to the vertical direction V.

The terms "horizontal" and "vertical" refer to the state in which the microprojection light module is installed in a vehicle headlight mounted in the vehicle.

The light source 2 is preferably at least one semiconductor-based light source, which comprises one, two or more LEDs and/or laser diodes, for example.

The light source 2 radiates the light thereof into a supplementary lens 4, such as a collimator, which orients the light of the light source 2 substantially parallel before the light impinges on the projection device 3.

As shown in FIG. 1, this projection device 3 comprises an entrance lens system 30, which is composed of an array of micro entrance lenses 31, and an exit lens system 40, which is composed of an array of micro exit lenses 41, wherein exactly one micro exit lens 41 is associated with each micro entrance lens 31. Moreover, the projection device comprises a first diaphragm device 50 and a second diaphragm device 60.

In a light module according to the invention in accordance with FIG. 1, the micro entrance lenses 31 are designed in such a way and/or the micro entrance lenses 31 and the micro exit lenses 41 are arranged relative to each other in such a way that the light exiting a micro entrance lens 31 enters exactly only the associated micro exit lens 41, and wherein the light preshaped by the micro entrance lenses 31 is imaged by the micro exit lenses 41 into a region in front of the motor vehicle as at least one light distribution LV1 to LV5; GLV.

Furthermore, as is generally apparent from the figures, a first diaphragm device 50 and a second diaphragm device 60 are arranged between the entrance lens system 30 and the exit lens system 40. As will be described in greater detail hereafter, the first diaphragm device 50 can be used to cut the luminous flux passing through the projection device so as to be able to generate one or more light distributions having defined shapes, for example having one or more light-dark boundaries. By using the second diaphragm device 60, the light distribution generated by way of the diaphragm device 50 can be substantially corrected. For example, in the case of a first diaphragm device 50 (see, for example, FIG. 3) provided for generating a low-beam light distribution, the second diaphragm device 60, 70, 80 (FIGS. 4, 5, 13 to 15) is used, among other things, to reduce the chromatic aberrations (longitudinal and/or lateral chromatic aberrations) in the light pattern, these aberrations possibly resulting in a discoloration of the light-dark boundary and being perceived as unpleasant and bothersome by the human eye.

For the sake of completeness, it shall be noted here that the illustration in FIG. 1 comprising a substantially light first diaphragm device 50 and a substantially dark second diaphragm device 60 provides no information as to the configuration of the diaphragm devices 50, 60. The illustration shall be understood to be purely schematic and is merely intended to demonstrate the presence of a first diaphragm device 50 and of a second diaphragm device 60, and the approximate positions thereof.

The entrance lens system 30 is a single component, which is formed of the micro entrance lenses 31. The micro entrance lenses 31 directly abut one another, preferably without distance, and form an array, as mentioned above and shown in FIG. 1.

Additionally, the exit lens system 40 is a single component, which is formed of the micro exit lenses 41. The micro exit lenses 41 directly abut one another, preferably without distance, and form an array, as mentioned above and shown in FIG. 1.

Moreover, as will be described in greater detail hereafter, the entrance lens system and the exit lens system, optionally together with a respective diaphragm device, can be designed in one piece. For example, the entrance lens system together with the first diaphragm device and the exit lens system together with the second diaphragm device can be designed in one piece.

FIGS. 2*a* and 2*c* show a micro lens system comprising a micro entrance lens 31 and an associated micro exit lens 41, which, as described above, are designed and/or arranged in such a way that light from the shown micro entrance lens 31 exclusively enters the associated micro exit lens 41. The optical axis 310 of the micro entrance lens 31 coincides with the optical axis 410 of the micro exit lens 41. Furthermore, FIG. 2*a* shows a portion of the first diaphragm device 50 and of the second diaphragm device 60 in the region between the two micro lenses 31, 41.

From a look at the micro lens systems from FIGS. 2*b* and 2*d*, it is apparent, in FIG. 2*b*, that the micro entrance lens 31 focuses the light passing through it in the vertical direction into a micro lens focal point F1, wherein the micro lens focal point F1 preferably coincides with the focal point of the micro lens system comprising the micro entrance lens 31 and the micro exit lens 41. FIG. 2*b* thus shows rays located in a vertical plane (namely plane A-A from FIG. 2*a*), or the projection of rays into this plane A-A.

The rays exiting the supplementary lens (not shown here) in a parallel manner are thus focused by the micro entrance lens 31 into the micro lens focal point F1, which is located in front of the associated micro exit lens 41, as viewed in the light exit direction.

As was already mentioned at the outset, it shall be mentioned again here for the sake of completeness that focusing "into a focal point" is mentioned here, and in general within the scope of the present entire disclosure in other passages, for easier wording. In fact, which is to say in reality, the rays are not focused into a single focal point, but are imaged into a focal surface which includes the aforementioned focal point. This focal surface may be a focal plane; however, in general, this focal surface is not planar, due to aberrations and corrections of a higher order, and these corrections, in addition to the paraxial approximation, must be taken into account in the consideration of the light propagation of rays that form a large angle with respect to the optical axis, but instead this focal surface may also have a curved "shape," which is to say the rays are imaged into a curved surface which includes the focal point. The curvature of the focal surface results in defects in the generated light distribution (see FIG. 3*a* and FIG. 3*b*).

Each micro lens system thus has a focal point F1, which is located between the entrance lens system and the exit lens system, and into which light of the associated micro entrance lens is preferably focused.

Moreover, the micro exit lens 41 has a focal point, this focal point coinciding with the micro lens focal point F1 and with the focal point of the micro entrance lens 31 of the associated micro exit lens 41. Light is thus focused into the focal point F1 and subsequently, upon passing through the associated micro exit lens 41, is collimated accordingly in the vertical direction and projected into a region in front of the vehicle, as is schematically illustrated in FIG. 2*b*.

FIG. 2*d* furthermore shows the behavior in the horizontal direction, which is to say rays are considered which are located in a horizontal plane, such as in plane B-B from FIG. 2*c*, or the projection of rays into this plane. As is apparent from FIG. 2*d*, each micro lens system, comprising the micro entrance lens 31 and the micro exit lens 41, widens the light passing through it in the horizontal direction. For this purpose, each micro lens system focuses the light passing through this micro lens system in the horizontal direction onto a focal point F2, which is located behind the micro exit lens 41 (in the main radiation direction). The light is thus scattered in the horizontal direction, so as to achieve the desired width of the partial light distributions of the individual micro lens systems.

It shall be noted again here that idealized optical systems are described here; in practice, both the first lens system (micro entrance lens) and the second lens system (micro exit lens) of a micro lens system are often implemented in a free-form design, resulting in imaging, as described above, into a focal surface. Furthermore, at least a portion SL of the light will exit from a micro lens system between the micro entrance lens 31 and the associated micro exit lens and scattered into a micro lens system adjoining the micro lens system (FIG. 2*b*). This results in what is known as crosstalk between the micro lens systems, whereby a defective light distribution (see 3*a*, 3*b*) is generated. An essential feature of the above-described micro lens systems is that these widen the light passing through them in the horizontal.

The micro entrance lenses 31 are preferably designed as converging lenses, which cause the light to come together in the vertical and/or horizontal directions. The micro entrance lenses 31 can be designed as free-form lenses, for example.

The use of micro entrance lenses that converge light in the vertical direction V and/or in the horizontal direction H depends on the particular application of the microprojection light module. For example, micro entrance lenses 31 that converge the light in the vertical direction V (FIG. 2*b*) and leave it substantially defocused in the horizontal direction H (FIG. 2*d*), or even widen it, can be used to generate a wide light distribution (for example, of a low-beam light distribution). The micro exit lenses 41 can be arranged in such a way that the focal points thereof coincide, in the vertical direction V, with the focal point F1 of the corresponding micro entrance lenses. This may cause the light exiting the micro lens systems to be focused in the horizontal direction H into the focal point F2, wherein these focal points F2 are substantially located in a horizontal plane. As a result of the focal points F2 substantially located in a horizontal plane being arranged a small distance behind the micro exit lenses, each micro lens system widens the light beam passing through this micro lens system, as is apparent from FIG. 2*d*, for example. A "small distance" here shall be understood to mean a size in the millimeter to centimeter range, for example in a range of 1 mm to 10 cm, which is "small" compared to the distance at which lighting-related measurement in motor vehicle construction is carried out (a light distribution radiated by a motor vehicle headlight is usually measured on a measuring screen positioned at a distance of 25 meters transversely to the main radiation direction). Micro entrance lenses converging light both in the horizontal direction and in the vertical direction can be used to generate a less wide light distribution, for example a high-beam light partial distribution. Each micro entrance lens would thus focus the light both in the vertical and in the horizontal direction onto a focal point, the focal point being located in front of the micro exit lens. In this way, widening of the light beam passing through the micro lens system in the horizontal direction can be avoided, and a substantially oval (with a projection onto the aforementioned screen) light distribution can be generated, which can be used, for example, to generate a high-beam light distribution.

The micro exit lenses 41 are usually designed as projection lenses, which is to say as spherical or aspherical lenses. It may also be provided that the micro exit lenses 41 are free-form lenses.

At this point, FIGS. 8*a* to 8*c* shall be briefly referenced: above and in the description hereafter, it is assumed that each micro entrance lens 31 and each micro exit lens 41 is formed of a respective single lens. However, it may also be provided that either the micro entrance lenses 31 and/or the micro exit lenses 41 themselves each again comprise one, two or more "lenses" or optical elements. Each of these "micro micro optical elements" of a micro lens must have the same focal plane for this purpose. For example, one or both micro lenses can be Fresnel lenses, which have different optically effective regions. Each of the optical regions (micro micro lens) of a micro entrance lens can, but does not have to, radiate light into each micro micro exit lens.

FIG. 8*a* shows an example in which the micro entrance lens 31 in a micro lens system is designed as a Fresnel lens, and the micro exit lens 41 is designed as a "conventional" lens.

FIG. 8*b* shows an example in which the micro entrance lens 31 is designed as a "conventional" lens, and the micro exit lens 41 is designed as a Fresnel lens.

FIG. 8*c* shows an example in which the micro entrance lens is designed as a "conventional" lens, and the micro exit lens is designed as an array of micro lenses.

FIGS. 8*a* to 8*c* show only a few conceivable variants, combinations or other subdivisions of the micro lenses and the diaphragm devices. What is important is that the second diaphragm device 60, 70 is arranged in the light propagation direction between the first diaphragm device 50 and the micro exit lens 41 and acts as an aperture stop. The position of the second diaphragm device 60, 70 can thus not be freely selected in the beam path. The first diaphragm device 50 is a field diaphragm/field stop. With respect to the quality of the light pattern, it is advantageous to dispose the first diaphragm device in the focal surface or in the intermediate image plane of the micro lens system.

Furthermore, as is apparent from FIGS. 2*a* and 2*c*, the mutually facing interfaces 31', 41' of mutually associated micro entrance lenses 31 and micro exit lenses 41 are designed so as to be congruent, and preferably are also arranged congruently with respect to one another.

It is also expedient when the interfaces 31', 41' are planar.

In the example shown, the interfaces 31', 41' are square; other possible shapes are rectangular or hexagonal.

The optical axes 310, 410 (FIGS. 2*b*, 2*d*) of mutually associated micro entrance lenses 31 and micro exit lenses 41 advantageously extend parallel to one another, wherein it is in particular advantageous when the optical axes 310, 410 coincide.

The first diaphragm device 50 is located in a plane spanned by the micro lens focal points F1.

The diaphragm device 50 preferably comprises a respective diaphragm for each micro lens system (see FIGS. 2*a*, 2*c*), the diaphragm having one or more optically effective diaphragm edges.

The second diaphragm device 60 is located between the first diaphragm device 50 and the exit lens system 40. The second diaphragm device 60 preferably comprises a respective diaphragm for each micro lens system (see FIGS. 2*a*, 2*c*), the diaphragm having one or more optically effective diaphragm edges and being used to prevent scattered light SL (FIG. 2*b*) from passing through.

FIGS. 2*a*, 2*c* show a micro lens system, which is associated with a first diaphragm 52 having an optically effective diaphragm edge 52', and a second diaphragm 62 having a further optically effective edge 62'. The light passing through this system is initially cut in keeping with the first diaphragm edge 52', and the diaphragm edge 52' is imaged as a light-dark boundary in the light pattern. Furthermore, the light is cut in keeping with the second diaphragm edge 62' in such a way that no crosstalk takes place between the individual micro lens systems, and the aberrations of the light distribution GLV caused by the curvature of the focal surface (see FIGS. 3*a*, 3*b*) are eliminated.

The first diaphragm device 50 and the second diaphragm device 60 comprise a diaphragm for at least one pair of mutually associated micro entrance and micro exit lenses 31, 41. The first diaphragm device 50 and the second diaphragm device 60, however, preferably comprise a diaphragm 51, 52, 53, 54, 55 or 61, 62, 63, 64, 65, having at least one respective, and for example exactly one, optically effective diaphragm edge 51', 52', 53', 54', 55' or 61', 62', 63', 64', 65', for multiple pairs, and in particular for all pairs.

The first diaphragm device 50 known from the prior art is schematically illustrated in FIG. 3. FIG. 3 shows the first diaphragm device 50 in a view from the front, wherein the first diaphragm device 50 comprises five different types of diaphragms 51 to 55. Each of these diaphragms 51 to 55 is made of an opaque material 51" to 55", which includes exactly one (as shown) or more (not shown) translucent through-passages 51'" to 55'" through which light is able to pass. The diaphragm edges 51', 52', 53', 54', 55' of the diaphragms are imaged in the respective partial light pattern as top light-dark boundaries, which delimit the light pattern toward the top.

Each of these diaphragms is associated with exactly one micro lens system, and when all micro lens systems are irradiated with light, an overall light distribution GLV, as shown schematically in FIG. 3*a*, is obtained as the superimposition of all partial light distributions. In the shown example, the overall light distribution GLV is a low-beam light distribution having an asymmetrical light-dark boundary.

FIG. 3*b* shows one each of the diaphragms 51 to 55 and, to the left of the diaphragms, it schematically shows the respective partial light distribution LV1 to LV5 generated therewith.

It is clearly discernible that aberration sub-regions X1, X2, X3, X4, X5, X6 are created in the partial light distributions LV2, LV4, LV5 as a result of aberrations and crosstalk between adjoining micro lens systems, the superimposition of these aberration sub-regions resulting in the creation of major aberration regions Y1, Y2, Y3 in the overall light distribution GLV.

FIG. 4 shows a second diaphragm device 60 according to the invention, with the aid of which aberrations are eliminated. The second diaphragm device 60 is shown in a front view. Five different types of diaphragms 61 to 65 are apparent, which the second diaphragm device 60 comprises. Each of these diaphragms 61 to 65 is made of an opaque material 61", 62", 63", 64", 65", which includes exactly one (as shown) or more (not shown) translucent through-passages 61'", 62'", 63'", 64'", 65'" through which light is able to pass. As a result of the through-passages, the light pattern, which was already cut with the aid of the first diaphragm device, is cut further in such a way that aberration sub-regions X1 to X6, and consequently also major aberration regions Y1, Y2, are no longer present in the generated partial light distributions and light distributions. This is achieved by the shaping of the diaphragm edges. It has proven to be particularly advantageous to have a gable-like design of the lower diaphragm edge 62', 63', 64', 65' of the diaphragms, but generally a shape that ascends obliquely from the center outward. These are imaged in the respective partial light pattern as top light-dark boundaries, which delimit the light pattern toward the top. The opaque regions 61" to 65" are designed and configured in such a way that no crosstalk takes place between the micro lens systems, which is to say no scattered light SL (portion SL of the light in FIG. 2*d*) from one micro lens systems finds its way into the adjoining micro lens system. In this way, the aberration Y2 is reduced or eliminated.

FIG. 4*a* shows one of the diaphragms 61 to 65 and, to the left of the diaphragms, it schematically shows the respective partial light distribution LV1' to LV5' generated therewith, without aberrations X1 to X6, Y1, Y2.

FIG. 5 shows a further exemplary embodiment of the second diaphragm device 70 according to the invention. Compared to the second diaphragm device 60 from FIGS. 4 and 4*a*, at least a portion of the diaphragms 73*a* to 73*d* and 75*a* to 75*f* of the second diaphragm device 70 from FIG. 5 has a respective translucent through-passage 73*a*'" to 73*d*'" and 75*a*'" to 75*f*'". The diaphragms 73*a* to 73*d* and 75*a* to 75*f* are arranged in such a way that the light passing through the through-passages 73*a*'" to 73*d*'" and 75*a*'" to 75*f*'" thereof forms partial light distributions LV3" and LV5" (FIG. 5*a*), wherein the partial light distributions LV3" and LV5" contribute to a region in the center of the overall light distribution, which is to say around the desired maximum of the illumination intensity of the radiated light distribution, in which a higher illumination intensity is required, for example.

The embodiment of the second diaphragm device 70 shown in FIG. 5 is particularly advantageous since, for example, the use of the second diaphragm device 60 from FIG. 4 would cause the majority of the luminous flux to be shadowed and therefore, for example, statutory luminous flux values would not be achieved at the HV point. The reason for this is that the light necessary for generating the partial light distributions LV3 to LV5 is strongly focused in the focal surface or intermediate image plane of the projection device. The further propagation of the ray takes place in such a way that some of the rays are able to form a large angle with respect to the optical axis, so that the through-passages 73*a*'" to 73*d*'" and 75*a*'" to 75*f*'" of the second diaphragm device 70 have to be very large to allow a sufficient amount of light to pass through.

In this way shown in FIGS. 4, 4*a*, 5, 5*a*, for example, an aberration-free low-beam light distribution can be generated by way of a light module according to the invention, wherein individual micro lens systems each generate a defined contribution to the aberration-free low-beam light distribution in the form of an aberration-free partial light distribution.

These light modules can additionally be used to generate arbitrary aberration-free overall light distributions. As a result of the group-wise illumination of micro lens systems comprising the first and second diaphragms by way of at least one respective dedicated light source, it is possible to specifically activate (or suppress) predefined aberration-free partial light distributions (determined by the shape of the diaphragm edge), whereby a dynamic light distribution can be generated, for example.

The design of the entrance lens(es) and exit lens(es), in some circumstances, may only allow limited shaping of the light distribution. By using preferably standardized diaphragms, as described above, it is possible to generate one, two or more partial light distributions, which result in the desired overall light distribution when appropriately selected.

The diaphragms can also be designed as individual diaphragms, for example, which "form" the diaphragm device; preferably, however, as is shown, these are diaphragm device components, such as flat foils and the like, in which corresponding openings/through-passages for light to pass through are provided.

With respect to the arrangement of the second diaphragm device 60, 70, care must be taken to ensure that this is correctly positioned with respect to the first diaphragm device 50. This means that, when both diaphragm devices are installed, the types of diaphragms of the second diaphragm device 60, 70 should correspond to the particular types of the first diaphragm device 50, as is apparent from FIGS. 2*a* and 2*c*, for example. With reference to FIG. 3, FIG. 4 and FIG. 5, the diaphragms of the first diaphragm row 51 of the first diaphragm device 50 should correspond to the diaphragms of the first diaphragm row 61, 71 of the second diaphragm device 60, 70, the diaphragms of the second diaphragm row 52 of the first diaphragm device 50 should correspond to the diaphragms of the second diaphragm row 62, 72 of the second diaphragm device 60, 70, and so forth.

As was already briefly addressed above, it may be provided in a first embodiment of the invention, as shown in FIG. 6*a*, that the projection device 3 comprising an entrance lens system 30 and an exit lens system 40 of a first diaphragm device 50 and a second diaphragm device 60, 70 is designed in one piece. The lens body is a plastic lens, for example, which was deliberately carbonized to implement diaphragm devices. Such carbonization can take place, for example, by way of laser beams or electron beams and the like.

In a second variant, which is shown in FIG. 6*b*, it is provided that the projection device 3 is formed of two separate components, these being an entrance lens system 30 and an exit lens system 40, which typically are also arranged at a distance from one another. It is advantageous when the first diaphragm device 50 is arranged on the interface 31' of the entrance lens system 30 which faces the exit lens system 40, and the second diaphragm device 60, 70 is arranged on the interface 41' of the exit lens system 40 which faces the entrance lens system 30.

A diaphragm device can be generated by vapor coating one of the interfaces 31' or 41', or by applying an absorbing layer, which thereafter is deliberately removed again, such as way by way of laser beams. It is also conceivable to apply an exit lens system onto an entrance lens system thus provided with a diaphragm device, for example, by way of two-component injection molding, so that ultimately one component is obtained again.

However, in this case it may also be provided that both diaphragm devices 50, 60, 70 are designed as components configured separately from the entrance lens system 30 and the exit lens system 40, as is shown in FIG. 6*c*. In this case, the diaphragm devices 50, 60, 70 can be inserted in the form of a precise mask, for example made of metal (shadow mask, slot mask, screen and the like).

The variants shown in FIGS. 6*a* to 6*c* can, of course, be combined. So as to be able to set the projection device 3 (distances of the focal planes, orientation of the optical axis and the like), for example, it may be advantageous to design the second diaphragm device 60, 70 separately from the exit lens system 40, the first diaphragm device, however, in one piece with the entrance lens system 30, or the first diaphragm device 50 in one piece with the second diaphragm device 60, 70, but separately from the entrance lens system 30 and the exit lens system. With respect to the quality of the light pattern, it is advantageous when the first diaphragm device 50 is located in the surface area spanned by the focal points of the micro lens systems, which forms the focal surface of the projection device 3. The light pattern is then defined by the shape of the first diaphragm device 50, and is corrected by the second diaphragm device 60, 70 and brought into an aberration-free state.

It shall be noted at this point that the inner surfaces of the lens systems 30, 40 are planar in the existing figures, while the outer surfaces are curved. In principle, it is also possible for one inner surface or both inner surfaces of the lens systems 30, 40 to be curved; however, this is only possible with a two-piece or multi-piece configuration.

A one-piece configuration has the advantage that, after production, which must be carried out with precision, a single, stable component is available, which can be installed without difficulty.

In a conventional projection system comprising a projection lens, the lens typically has a diameter between 60 mm and 90 mm. In a module according to the invention, the individual micro lens systems have typical dimensions of approximately 2 mm×2 mm (in V and H), and a depth (in Z) of approximately 6 mm to 10 mm, resulting in a considerably smaller depth of a module according to the invention in the Z direction compared to conventional modules.

The light modules according to the invention have a lower depth and, in general, can be shaped freely, which is to say it is possible, for example, for a first light module for generating a first partial light distribution to be configured separately from a second light module for a second partial light distribution, and to dispose these offset from one another relatively freely, which is to say vertically and/or horizontally and/or in terms of depth, so that design specifications are also easier to implement.

It is a further advantage of a light module according to the invention that, while the projection device must be produced with very high precision, which is easily possible with current manufacturing methods, the exact positioning of the light source(s) in relation to the projection lens is eliminated. Exact positioning is of lesser importance in so far as the at least one light source illuminates an entire array of micro entrance lenses, which all essentially generate the same light pattern. In other words, this means nothing other than that the "actual" light source is formed by the real light source(s) and the array of the micro entrance lenses.

This "actual" light source then illuminates the micro exit lenses and, if necessary, the associated diaphragms. However, since the micro entrance and micro exit lenses are already optimally matched to one another, these forming essentially a system, less than exact positioning of the real light source(s) carries less weight.

FIG. 7 shows an illumination device for a vehicle headlight, which comprises one, two or more microprojection light modules as described above. Multiple groups of different light modules are provided, for example FIG. 7 shows light modules of groups AA, AA1, AA2, SS1, BF1 to BF8, FL, ABL, SA1, SA2, which together form the illumination device. Each group AA, AA1, AA2, SS1, BF1 to BF8, FL, ABL, SA1, SA2 comprises one, two or more light modules.

In the example shown, each group comprises exactly one light module, which are listed hereafter: They are denoted as follows:

AA a light module for generating an asymmetrical aberration-free low-beam light $LV_{AA}$ in the far field;

AA1, AA2 aberration-free asymmetrical low-beam light $LV_{AA1}$, $LV_{AA2}$ in the far field in the cornering light module;

SS1 light module for generating a symmetrical aberration-free light distribution $LV_{SS1}$ (apron of a low-beam light, city light);

BF1 to BF8 light modules for generating an aberration-free and no-dazzle high-beam light $LV_{BF1}$ to $LV_{BF8}$; the individual aberration-free light distributions $LV_{BF1}$ to $LV_{BF8}$ together generate an aberration-free high-beam light distribution, or a portion thereof, and the individual aberration-free light distributions can be suppressed independently of one another, if needed;

FL a light module for generating an aberration-free high-beam light $LV_{FL}$;

ABL a light module for generating an aberration-free turning light $LV_{FL}$;

SA1, SA2 additional light components for aberration-free highway light $LV_{SA1}$, $LV_{SA2}$.

It is advantageous with such an illumination device when the light sources of each group of light modules AA, AA1, AA2, SS1, BF1 to BF8, FL, ABL, SA1, SA2 can be actuated independently of the light sources of the other groups, so that the individual aberration-free light distributions, or partial light distributions, can be switched on and off and/or dimmed independently of one another.

FIG. 7 is a purely schematic representation, and reference is made to "light modules" in connection with FIG. 7. In fact, FIG. 7 shows only and purely schematically the projection devices AA, AA1, AA2, SS1, BF1 to BF8, FL, ABL, SA1, SA2 of the individual micro projection light modules and, as is apparent from FIG. 12, the projection devices AA, AA1, AA2, SS1, BF1 to BF8, FL, ABL, SA1, SA2 of the individual light modules form a joint component, for example in the form of a curved ribbon. These projection device can be arranged on a foil, for example.

It is thus possible, by way of the present invention, to freely form the lens arrays from micro entrance and micro exit lenses, and it is also possible to combine two or more light modules according to the invention via a joint projection device component to form an illumination device, wherein then preferably the micro lens systems are designed to be identical in the regions of the projection device component which are associated with a particular light module (and thus with an independently actuatable light source).

FIG. 9*a* and FIG. 9*b* show two further embodiments. It is provided that different regions, for example exactly three different regions, of micro lens systems 3 are illuminated with light sources 2 of different colors R, G, B, for example one region with red light R, another region with green light G, and a third region with blue light B.

The different regions can belong to one projection device 3 (FIG. 9*a*), but also to different (two or more, such as three, as shown in FIG. 9*b*) projection devices, or to one projection device or to two or more, and in particular three, projection devices. It is only important that each region of micro lens systems generates the same light distribution as the other regions. So as to take the above-described chromatic aberrations into account, it is provided in the projection device from FIG. 9*a* that the first diaphragm device comprises three partial diaphragm devices 50R, 50G, 50B, wherein each partial diaphragm device is arranged in the focal surface corresponding to the respective color. The focal points of the micro lens systems for the red light L are thus, as seen in the light propagation direction, located further forward than the focal points of the micro lens systems for the green light G, which, in turn, are located in front of the focal points of the micro lens systems for the blue light B, as is apparent from FIG. 9*a*.

The embodiment shown in FIG. 9*a* has the advantage that all light sources, which emit light of different colors, are associated with a single, preferably one-piece, entrance lens system. It may also be provided that the first diaphragm device and/or the second diaphragm device comprise three partial diaphragm devices, which can be used to correct the chromatic aberrations.

In the embodiment shown in FIG. 9*b*, there are three projection devices 3R, 3G, 3B, which can be designed in one piece or separately from one another. The first diaphragm device 50 and the second diaphragm device 60, 70 are provided. In the example, the projection devices differ in the shape of the entrance lens systems 30R, 30G, 30B, which are designed in such a way that the focal surfaces of the three projection devices 3R, 3G, 3B, each corresponding to one color, coincide. This effect can be achieved, for example, by adapting the thicknesses and/or the curvatures of the micro entrance lenses forming the entrance lens systems. By varying the thicknesses and/or the curvatures of the micro entrance lenses, the focal distances of the micro lens systems are changed, whereby the distance between the interface 31' of the entrance lens system 30 which faces the exit lens system 40 and the focal surface can be established independently of the color of the light R, G, B, as is shown in FIG. 9*b*. The first diaphragm device 50 from FIG. 9*b*, which preferably has a one-piece design, is arranged in the coinciding focal surfaces of the projection devices 3R, 3G, 3B. The embodiment shown in FIG. 9*b* has the advantage of offering great design freedom, which can be ensured, for example, by three projection devices 3R, 3G, 3B designed separately from one another.

Superimposing the aberration-free light patterns from the different regions then, in the overall, yields a white aberration-free light pattern.

If laser light sources are used as light sources in this connection—see, in particular, also the explanations provided above—only few microprojection arrays (regions) are required to generate a white light distribution due to the high light intensities of lasers, so that a smaller light module can be created in the lateral direction.

Figure 10:
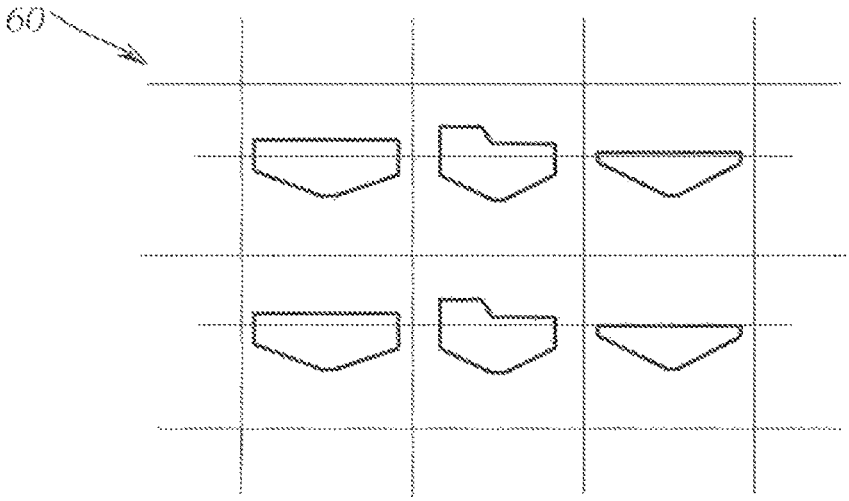
Figure 11:
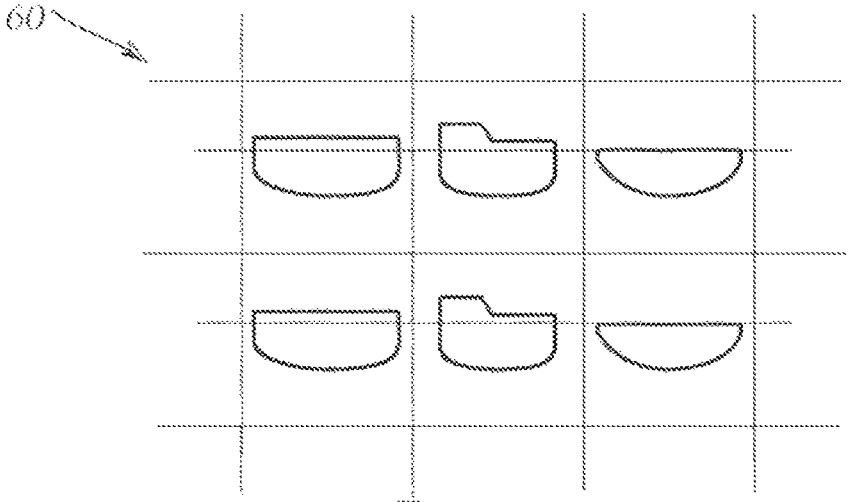
Figure 12:
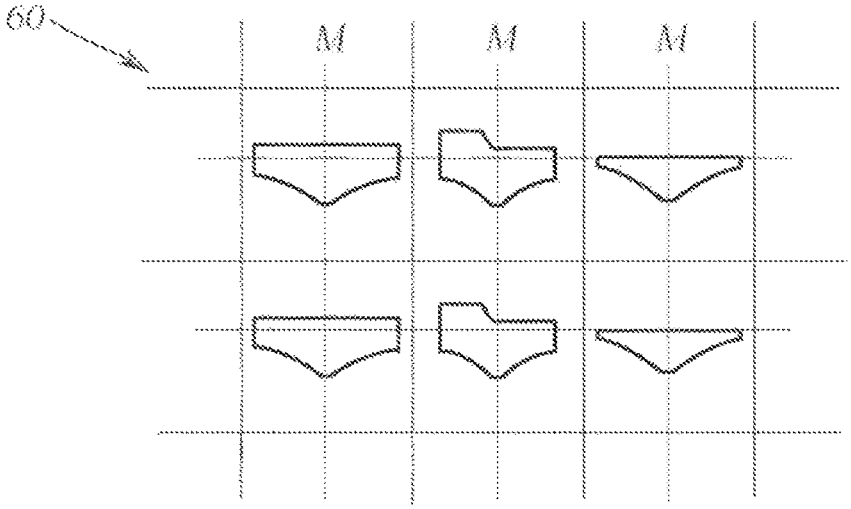
Figure 13:
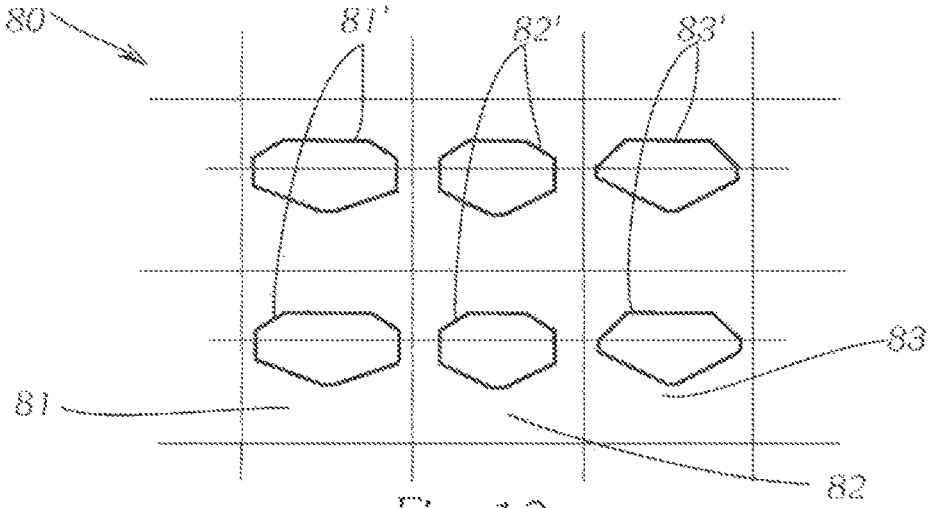
Figure 14:
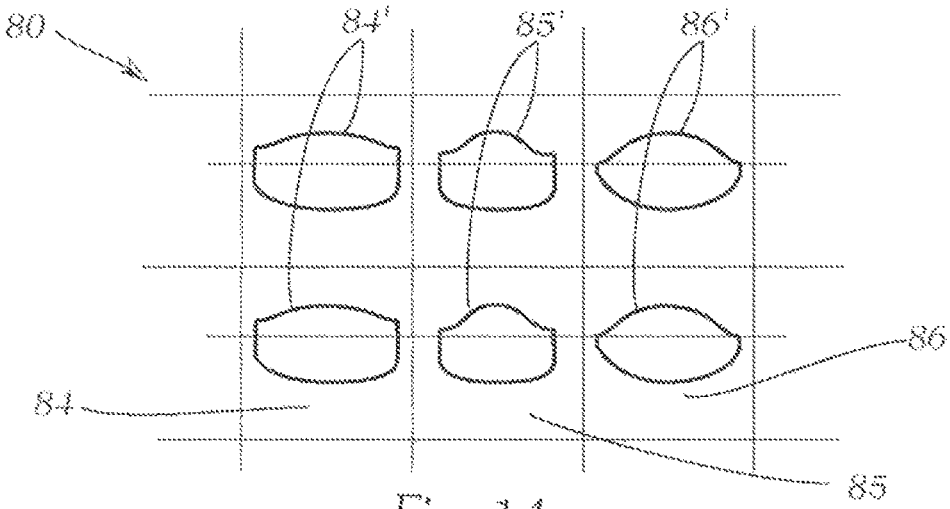
Figure 15:
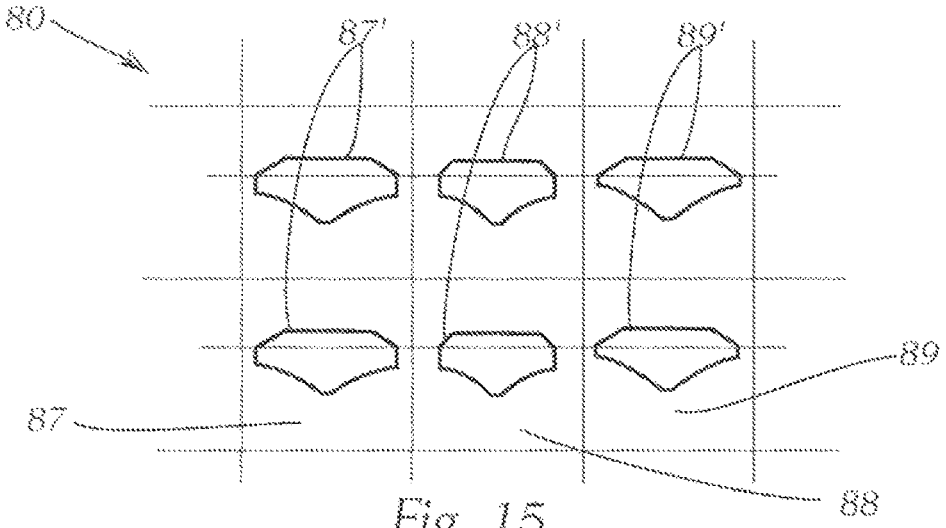

Finally, it shall be noted that the diaphragms of the second diaphragm device can have differently configured lower (for correcting the aberrations Y1, Y2 from FIG. 3*a*) and/or upper (for correcting the aberration Y3 from FIG. 3*a*) optically effective diaphragm edges. This is addressed in FIGS. 10 to 15. FIG. 10 shows examples of diaphragms of the second diaphragm device 60, the lower diaphragm edges of which are designed as a triangular gable, which extends downwardly from the optical axis. FIG. 11 shows diaphragms, the lower diaphragm edges of which are designed as a segment of an ellipse (an elliptical arc), in particular of a circle (a circular arc). The diaphragms of FIG. 12 have lower diaphragm edges that comprise three diaphragm edge segments (for each of the shown diaphragms). Two diaphragm edge segments are designed as elliptical arcs or circular arcs curved inwardly toward the diaphragm stop, and are arranged mirror-symmetrically with respect to the vertical center line M extending through the optical axis. The third diaphragm edge segment is designed as a straight line. The embodiments of the lower diaphragm edges just described can help correct the above-described aberrations Y1, Y2 from FIG. 3*a*. The exact shape of the lower diaphragm edges of the second diaphragm device 60 can be adapted to the beam path between the micro entrance lens and the micro exit lens. However, it is advantageous when the lower diaphragm edges comprise at least two sections that steadily transition into one another, wherein the first (considered from left to right) section (in relation to the vertical direction V) is descending and the last section is ascending. FIG. 13 shows examples of diaphragms of the second diaphragm device 80, the upper diaphragm edges 81' to 83' of which are trapezoidal. The lower diaphragm edges are designed identically to the lower diaphragm edges of FIG. 10. FIG. 14 shows diaphragms, the upper diaphragm edges 84', 86' of which are designed as a segment of an ellipse (an elliptical arc), in particular of a circle (a circular arc). Moreover, FIG. 14 shows an upper diaphragm edge 85', which essentially has a curved gable-like progression. This gable-shaped progression (directed to the outside of the diaphragm stop) can have a steep, flat or normal shape. The progression of the lower diaphragm edges of FIG. 14 is substantially identical to the progression of the lower diaphragm edges of FIG. 11. The diaphragms of FIG. 15 have lower diaphragm edges that have a shape substantially identical to that of the lower diaphragm edges of FIG. 12. The upper diaphragm edges 87' to 89' are trapezoidal, as is the case in FIG. 13. The embodiments of the upper diaphragm edges just described can help correct the above-described aberrations Y3 from FIG. 3*a*. The exact shape of the upper diaphragm edges of the second diaphragm device 60, 70, 80 can be adapted to the beam path between the micro entrance lens and the micro exit lens. However, it is advantageous when the upper diaphragm edges comprise at least two sections that steadily transition into one another, wherein the first (considered from left to right) section (in relation to the vertical direction V) is ascending and the last section is descending.

The invention claimed is:

1. A microprojection light module (1) for a headlight of a motor vehicle, comprising:

a light source (2); and a projection device (3) configured to image light exiting the light source (2) into a region in front of the motor vehicle as a light distribution, the projection device (3) comprising:

an entrance lens system (30) including micro entrance lenses (31), which are arranged in an array; and an exit lens system (40) including micro exit lenses (41), which are arranged in an array, wherein each micro entrance lens (31) of the micro entrance lenses is associated with exactly one micro exit lens (41) of the micro exit lenses, wherein substantially all light exiting each micro entrance lens (31) enters only the exactly one micro exit lens (41) associated therewith, wherein light preshaped by the micro entrance lenses (31) is imaged by the micro exit lenses (41) into the region in front of the motor vehicle as the light distribution (LV1 to LV5; GLV), wherein a first diaphragm device (50) is arranged between the entrance lens system (30) and the exit lens system (40), and wherein a second diaphragm device (60, 70) is arranged between the entrance lens system (30) and the exit lens system (40), the second diaphragm device (60, 70, 80) comprising a diaphragm (61 to 65, 71 to 75, 81 to 89) having an optically effective diaphragm edge (61' to 65', 71' to 75', 81' to 89') for a pair of associated micro entrance and micro exit lenses (31, 41).

2. The microprojection light module according to claim 1, wherein the second diaphragm device (60, 70) is arranged between the first diaphragm device (50) and the exit lens system (40).

3. The microprojection light module according to claim 1, wherein a micro entrance lens (31) of the micro entrance lenses and a micro exit lens (41) of the micro exit lenses associated with the micro entrance lens (31) form a micro lens system comprising a micro lens focal point (F1).

4. The microprojection light module according to claim 3, wherein the micro entrance lens (31) focuses light passing through it into the micro lens focal point (F1).

5. The microprojection light module according to claim 3, wherein the micro lens focal point (F1) of the micro entrance lens (31) is located in front of the micro exit lens (41), in a light exit direction, wherein the micro entrance lens (31) is configured to focus light passing through it in a vertical direction onto the micro lens focal point (F1) located in front of the micro exit lens (40), and wherein the micro exit lens (41) comprises a focal point that coincides with the micro lens focal point (F1) of the micro entrance lens (31).

6. The microprojection light module according to claim 3, wherein the micro lens system widens light passing through it in a horizontal direction (H).

7. The microprojection light module according to claim 1, wherein each micro entrance lens (31) is designed as a converging lens, the converging lens causing light to come together in at least one direction.

8. The microprojection light module according to claim 1, wherein each micro exit lens (41) is designed as a projection lens, a spherical lens, an aspherical lens, or as a free-form lens.

9. The microprojection light module according to claim 1, wherein mutually facing interfaces (31', 41') of the pair of associated micro entrance and micro exit lenses (31) are designed to be congruent and planar.

10. The microprojection light module according to claim 1, wherein optical axes (310, 410) of the pair of associated micro entrance and micro exit lenses (31) extend parallel to one another and coincide.

11. The microprojection light module according to claim 1, wherein the first diaphragm device (50) is located in a plane spanned by a micro lens focal points (F1), the first diaphragm device (50) comprising a diaphragm (51 to 55) having an optically effective diaphragm edge (51', 52', 53', 54', 55') for the pair of associated micro entrance and micro exit lenses (31, 41).

12. The microprojection light module according to claim 11, wherein the diaphragm (51 to 55) has exactly one optically effective diaphragm edge (51', 52', 53', 54', 55') for multiple or all of the pairs of associated micro entrance and micro exit lenses (31, 41).

13. The microprojection light module according to claim 1, wherein the diaphragm (61 to 65, 71 to 75, 81 to 89), having the optically effective diaphragm edge (61' to 65', 71' to 75', 81' to 89'), for multiple pairs of the pair of associated micro entrance and micro exit lenses, comprises a gable-like progression.

14. The microprojection light module according to claim 13, wherein, with respect to a vertical direction (V), a lower optically effective diaphragm edge (61' to 65', 71' to 75') of the diaphragm (61 to 65, 71 to 75) and/or an upper optically effective diaphragm edge (81' to 89') of the diaphragm (81 to 89) comprise two or more curved and/or rectilinear segments.

15. The microprojection light module according to claim 14, wherein the lower optically effective diaphragm edge (61' to 65', 71' to 75') of the diaphragm (61 to 65, 71 to 75) and/or the upper optically effective diaphragm edge (81' to 89') of the diaphragm (81 to 89) comprise a triangular, trapezoidal, curved, or circular design.

16. The microprojection light module according to claim 13, wherein the second diaphragm device (60) is arranged in relation to the first diaphragm device (50) in such a way that the diaphragm (61 to 65, 71 to 75, 81 to 89) of the second diaphragm device (60, 70, 80) is offset parallel to a vertical direction (V), in relation to a diaphragm (51 to 55) of the first diaphragm device (50).

17. The microprojection light module according to claim 13, wherein the diaphragm comprises (i) a plurality of diaphragms having identical diaphragm edges or (ii) at least two diaphragms having differently configured diaphragm edges.

18. The microprojection light module according to claim 1, wherein the first diaphragm device (50) and the second diaphragm device (60) are spaced apart in a horizontal direction (H), designed identically, and/or in one piece, wherein the second diaphragm device (60) is arranged in a mirrored fashion in relation to the first diaphragm device (50) with respect to a horizontal plane (B-B).

19. The microprojection light module according to claim 1, wherein the first diaphragm device (50) is arranged on an interface (31') of the entrance lens system (30), which faces the exit lens system (40), and wherein the second diaphragm device (60, 70) is arranged on an interface (41') of the exit lens system (40), which faces the entrance lens system (30).

20. The microprojection light module according to claim 1, wherein the entrance lens system (30) and the exit lens system (40) are two separate components.

21. The microprojection light module according to claim 1, wherein the first diaphragm device (50) is a component that is separate from the entrance lens system (30), the exit lens system (40), and the second diaphragm device (60, 70), and wherein the second diaphragm device (60, 70) is a component separate from the entrance lens system (30) and the exit lens system (40).

22. The microprojection light module according to claim 1, wherein the projection device (3) comprising the entrance lens system (30), the exit lens system (40), the first diaphragm device (50), and the second diaphragm device (60, 70) are formed as one piece.

23. The microprojection light module according to claim 1, wherein the light source (2) comprises a semiconductor-based light source.

24. The microprojection light module according to claim 23, wherein the semiconductor-based light source comprises one, or more LEDs and/or laser diodes.

25. The microprojection light module according to claim 23, wherein the semiconductor-based light source comprises two or more semiconductor-based light sources which are actuatable independently of one another.

26. The microprojection light module according to claim 1, wherein a supplementary lens unit (4) is arranged between the light source (2) and the projection device (3), wherein the light source (2) is configured to radiate light emitted into the supplementary lens unit (4), and wherein the supplementary lens unit (4) is configured to direct light exiting therefrom substantially parallel to one another.

27. The microprojection light module according to claim 26, wherein the supplementary lens unit (4) comprises a collimator.

28. The microprojection light module according to claim 1, wherein exactly one light source, which comprises exactly one light-emitting diode or exactly one laser diode, is associated with each micro lens system comprising a micro entrance lens (31) and a micro exit lens (41).

29. An illumination device for a vehicle headlight, comprising the microprojection light module (1) according to claim 1.

30. The illumination device according to claim 29, further comprising groups of microprojection light modules (AA, AA1, AA2, SS1, BF1 to BF8, FL, ABL, SA1, SA2) wherein one group is configured to generate the same light distribution ($LV_{AA}$, $LV_{AA1}$, $LV_{AA2}$, $LV_{SS1}$, $LV_{BF1}$ to $LV_{BF8}$, $LV_{FL}$, $LV_{ABL}$, $LV_{SA1}$, $LV_{SA2}$), and wherein a different group is configured to generate a different light distribution ($LV_{AA}$, $LV_{AA1}$, $LV_{AA2}$, $LV_{SS1}$, $LV_{BF1}$ to $LV_{BF8}$, $LV_{FL}$, $LV_{ABL}$, $LV_{SA1}$, $LV_{SA2}$), wherein light sources of each group are actuatable independently of light sources of other groups, and wherein the projection devices (3) of one group form a joint component (300).

31. The illumination device according to claim 30, wherein two or more groups for generating different light distributions ($LV_{AA}$, $LV_{AA1}$, $LV_{AA2}$, $LV_{SS1}$, $LV_{BF1}$ to $LV_{BF8}$, $LV_{FL}$, $LV_{ABL}$, $LV_{SA1}$, $LV_{SA2}$) are provided, each group forming a different light distribution ($LV_{AA}$, $LV_{AA1}$, $LV_{AA2}$, $LV_{SS1}$, $LV_{BF1}$ to $LV_{BF8}$, $LV_{FL}$, $LV_{ABL}$, $LV_{SA1}$, $LV_{SA2}$), which is selected from one of the following light distributions ($LV_{AA}$, $LV_{AA1}$, $LV_{AA2}$, $LV_{SS1}$, $LV_{BF1}$ to $LV_{BF8}$, $LV_{FL}$, $LV_{ABL}$, $LV_{SA1}$, $LV_{SA2}$):

turning light light distribution;
city light light distribution;
rural road light light distribution;
highway light light distribution;
light distribution for auxiliary light for highway light;
cornering light light distribution;
low-beam light light distribution;
low-beam light apron light distribution;
light distribution for asymmetrical low-beam light in the far field;
light distribution for asymmetrical low-beam light in the far field in cornering light mode;
high-beam light light distribution; and
no-dazzle high-beam light light distribution.

32. A vehicle headlight, comprising at least one illumination device according to claim 29.

* * * * *